US010413134B2

(12) United States Patent
Kang et al.

(10) Patent No.: US 10,413,134 B2
(45) Date of Patent: Sep. 17, 2019

(54) AUTO-CLEANSING APPARATUS

(71) Applicant: GLOVICS CO., LTD., Incheon (KR)

(72) Inventors: Dae Yong Kang, Incheon (KR); Kyu Hak Han, Incheon (KR)

(73) Assignee: GLOVICS, CO., LTD, Incheon (KR)

( * ) Notice: Subject to any disclaimer, the term of this patent is extended or adjusted under 35 U.S.C. 154(b) by 891 days.

(21) Appl. No.: 14/758,347

(22) PCT Filed: Aug. 1, 2014

(86) PCT No.: PCT/KR2014/007084
§ 371 (c)(1),
(2) Date: Oct. 6, 2015

(87) PCT Pub. No.: WO2015/020357
PCT Pub. Date: Feb. 12, 2015

(65) Prior Publication Data

US 2016/0192814 A1 Jul. 7, 2016

(30) Foreign Application Priority Data

Aug. 7, 2013 (KR) ..... 10-2013-0093480

(51) Int. Cl.
*A61H 7/00* (2006.01)
*A46B 13/02* (2006.01)
(Continued)

(52) U.S. Cl.
CPC ..... *A47K 7/04* (2013.01); *A61H 7/005* (2013.01); *B08B 1/04* (2013.01);
(Continued)

(58) Field of Classification Search
CPC ..... A61H 23/00; A61H 23/0254; A61H 7/00; A61H 7/004; A61H 7/005; A46B 13/02;
(Continued)

(56) References Cited

U.S. PATENT DOCUMENTS 4,027,348 A 6/1977 Flowers et al.
4,526,163 A * 7/1985 Fedders ..... A61H 7/004 601/112
(Continued)

FOREIGN PATENT DOCUMENTS

JP 2003325607 11/2003
KR 200422511 7/2006
(Continued)

OTHER PUBLICATIONS

International Search Report—PCT/KR2014/007084 dated Sep. 26, 2014.

*Primary Examiner* — Justine R Yu
*Assistant Examiner* — Christopher E Miller
(74) *Attorney, Agent, or Firm* — Novick, Kim & Lee, PLLC; Jae Youn Kim

(57) ABSTRACT

An auto cleansing apparatus comprises: a drive unit which is equipped in a case and generates the rotation power; a pair of cams which may be rotated in accordance with the rotation power of the drive unit and wherein the positions of the cam sides may be changed by turns; a rotor link which is provided with a pair of the rotor arms to be contacted with the cam sides and which is rotated in the case to and fro while the rotor center shaft is rotated and the rotor arms may be moved forwardly and backwardly when the cam sides of the cams are changed by turns; and a rotor plate which has cleansing member equipped in one side and which is connected to the rotor link.

9 Claims, 19 Drawing Sheets

(51) Int. Cl.
*A47K 7/04* (2006.01)
*B08B 1/04* (2006.01)

(52) U.S. Cl.
CPC ..... *A61H 2201/0169* (2013.01); *A61H 2201/1215* (2013.01); *A61H 2201/1463* (2013.01); *A61H 2201/1481* (2013.01); *A61H 2201/1671* (2013.01); *A61H 2201/1678* (2013.01); *A61H 2205/022* (2013.01)

(58) Field of Classification Search
CPC ..... A46B 13/008; A46B 2200/102; A46B 2200/1006; A47K 7/04; B08B 1/04; A61C 17/24; A61C 17/26; A61C 17/32; A61C 17/34; A61C 17/3409; A61C 17/3456
See application file for complete search history.

(56) References Cited

U.S. PATENT DOCUMENTS 5,140,979 A * 8/1992 Nakagawa ..... A61H 23/0218 128/907
5,423,102 A * 6/1995 Madison ..... A46B 13/04 15/22.1
5,593,381 A * 1/1997 Tannenbaum ..... A61H 23/0218 601/101
6,247,931 B1 * 6/2001 Postal ..... A61C 1/07 433/118
2002/0156402 A1 * 10/2002 Woog ..... A61H 23/0236 601/46
2003/0158505 A1 * 8/2003 Calvert ..... A61H 7/001 601/110
2006/0122631 A1 * 6/2006 Kertz ..... A61B 17/54 606/131
2006/0149169 A1 * 7/2006 Nunomura ..... A61B 8/546 601/2
2007/0220689 A1 * 9/2007 Choi ..... A46B 9/04 15/22.2
2013/0060175 A1 * 3/2013 Chen ..... A61H 7/004 601/108
2013/0160786 A1 * 6/2013 Fujioka ..... A45D 19/14 132/200
2015/0202114 A1 * 7/2015 Pardoel ..... A61H 7/005 601/112

FOREIGN PATENT DOCUMENTS

KR 1020100088000 8/2010
KR 1020110134892 12/2011
KR 101240995 3/2013

* cited by examiner (a)

(b)

(c)

(d)

AUTO-CLEANSING APPARATUS

FIELD OF THE INVENTION

The invention relates to an auto cleansing apparatus, and more specifically, to the auto cleansing apparatus of the new structure which may prevent the case in which malfunction is generated even while operating for massage of skin as well as may prevent the case that unnecessary noise and vibration etc. are generated so that the reliability may be enhanced. And, the invention relates to the auto cleansing apparatus wherein the waterproof property is excellent and the main part may not be damaged even when falling into the water.

DESCRIPTION OF THE RELATED ART

Generally, any woman desires to have young and clean skin and elastic skin. Particularly, recently, it is the trend that the concern about skin is raised regardless of sex or age because it is the situation in which the concern about the appearance is raised.

Therefore, as described above, in order to maintain young, clean and elastic skin, various efforts are attempted. For example, the muscle massing is relaxed and the blood within skin smoothly streams down through the massage wherein stimulation including the light vibration etc. may be given to the skin and the skin is rubbed at the state of pressing, and metabolism may be accelerated and the fatigue as well as the pain may be resolved so that the subcutaneous fat is disassembled and the good skin may be made in the result.

Recently, the hand-held auto cleansing apparatus for performing the skin massage is developed to be used. According to the hand-held auto cleansing apparatus, the operated person does not receive the limit of space and time in the general home and he/she may personally perform the massage of the skin. For example, there can be Korean Patent Number 10-1056507 (KR10-1056507)(hereinafter it says to be for convenience registered patent). The registered patent comprises driving means for generating rotary power; cylindrical cam which is connected to the driving means to be rotated and which has cam groove for connecting top dead point to bottom dead point at the outer periphery; and vibration shaft. The vibration shaft has the extension plate and the follower. The extension plate is extended as the radial shape from the central axis line of the vibration shaft. The follower is formed at the end part of the extension plate. The follower is inserted in the cam groove to be reciprocated so that the vibration shaft may be reciprocated. According to the registered patent, the follower may be reciprocated between the top dead point and the bottom dead point by the rotary motion of the cylindrical cam, and the vibration shaft may be driven by the rotary motion of the follower and may perform the reciprocal vibration wherein the angle between the lower dead center and the top dead center is the circulation trajectory. The registered patent may be the implement performing bidirectional vibration and skin cleansing.

According to the registered patent, the rotation power may be delivered to the rotation of the cylindrical cam with the rotation of the slave gear and driving gear if the driving means rotates, and if the rotation of the cylindrical cam is started, the position of the follower sliding along the cam groove may be moved along the tract between the top dead center and the bottom dead point. The vibration shaft may be rotated toward one side based on the center as the predetermined angle in case the follower is positioned in the top dead center. The vibration shaft may be rotated toward the other side based on the center as the predetermined angle in case the follower is positioned in the bottom dead point.

As described above, while the position of the follower repetitively moves the top dead center to the bottom dead point by the rotation of the cylindrical cam, the vibration shaft may be repetitively vibrated, and, like this, if the vibration shaft may perform the reciprocal vibration wherein the angle between the lower dead center and the top dead point is the circulation trajectory, the vibration plate connected to the vibration shaft may be vibrated, and if the vibration plate is repetitively vibrated between the predetermined angle, the brush provided with the vibration member are rubbed against skin and the waste material amassed in skin may be removed.

By the way, in case of the registered patent, there is a problem that the vibration or the noise may be very much generated because the follower which repetitively moves along the section between the top dead point and the lower dead point according to the rotation of the cylindrical cam is provided at one eccentric position. The operation balance point is not steadily taken because the follower is provided at eccentric position. Therefore the vibration or the noise is much generated. The unhelpful vibration (it means the vibration generated between the major configurations in the massage of skin) or the unhelpful noise is inevitable due to the eccentricity between the cylindrical cam and the follower rotated with the driving means.

Moreover, in case of the registered patent, there is the risk that the above-mentioned major operating part, the follower is provided at one eccentric position and malfunction may be generated in the follower and the vibration shaft etc. As a result, there are many possibilities that product reliability falls down.

SUMMARY OF THE INVENTION

The invention has been made to solve the foregoing problems with the prior art, and therefore the purpose of the invention is to provide the auto cleansing apparatus of the new structure which may prevent the case that the unnecessary noise or the unnecessary vibration and so on may be generated while the main part operates for the administration of skin as well as may prevent the case that the malfunction of the main part is generated, as a result, may more enhance the reliability of the product.

Moreover, the other purpose of the invention is to provide the auto cleansing apparatus of new configuration which may beforehand prevent the damage of the main part because the sealing structure with excellent waterproof property may prevent the infiltration of the water in the inner side.

BRIEF DESCRIPTION OF THE DRAWINGS

The above and other aspects, features and advantages of certain exemplary embodiments of the invention will be more apparent from the following description taken in conjunction with the accompanying drawings, in which.

DETAILED DESCRIPTION OF THE INVENTION

Figure 1:
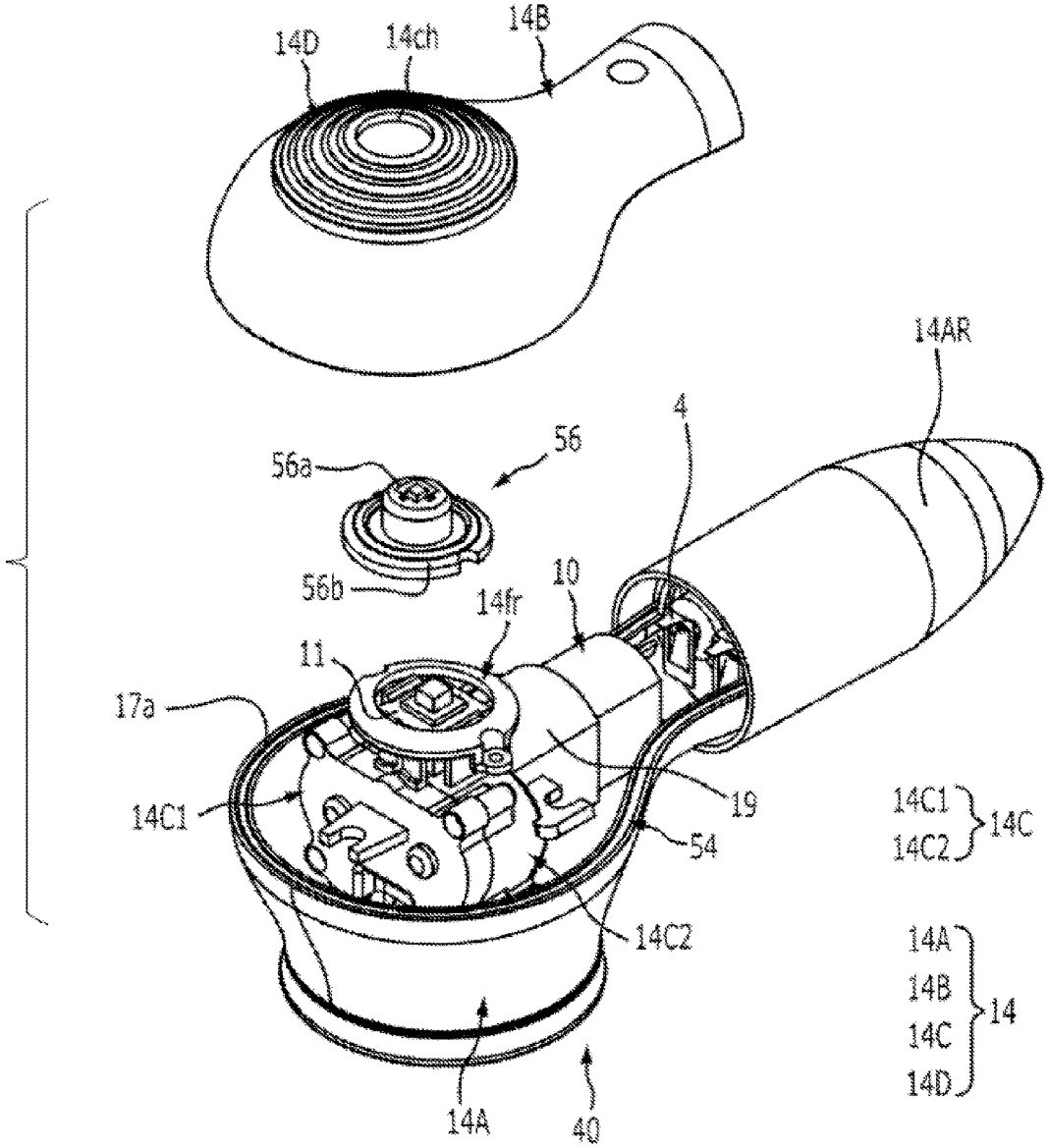
FIG. 1 is a disassembled perspective view partially showing the inner case having the cam and the rotor link which are the main part of the auto cleansing apparatus and part of the sealing member.
Figure 2:
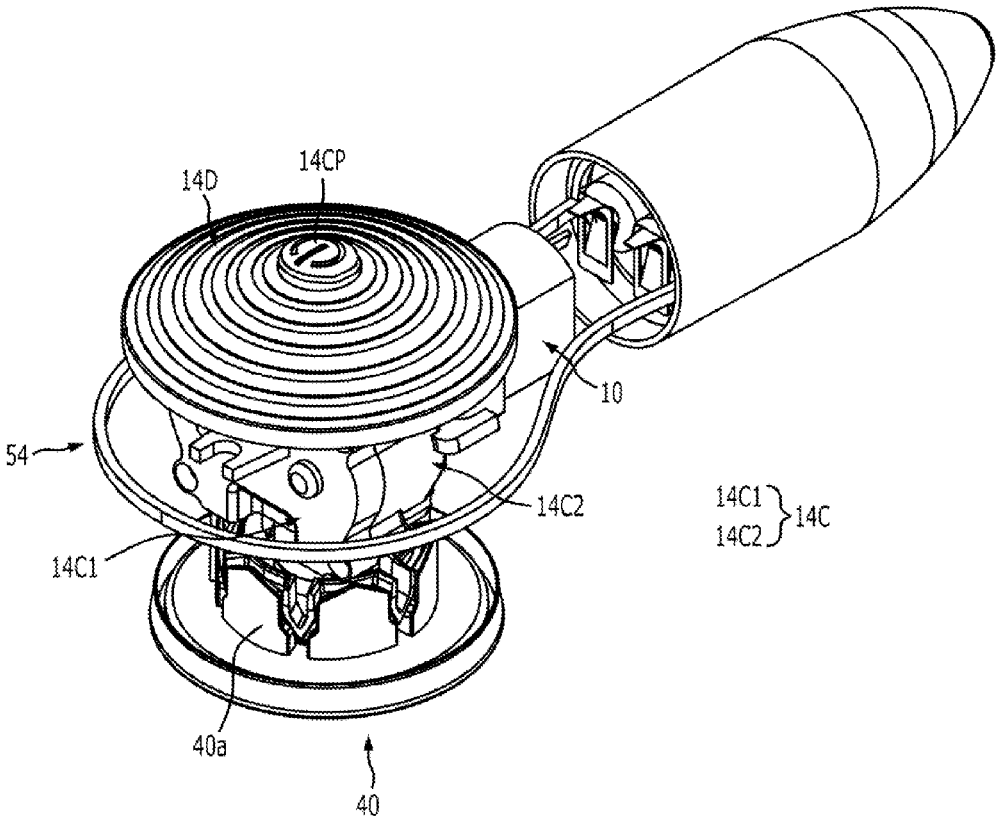
FIG. 2 is a perspective view showing the secondary case cover combined on the second case member.
Figure 3:
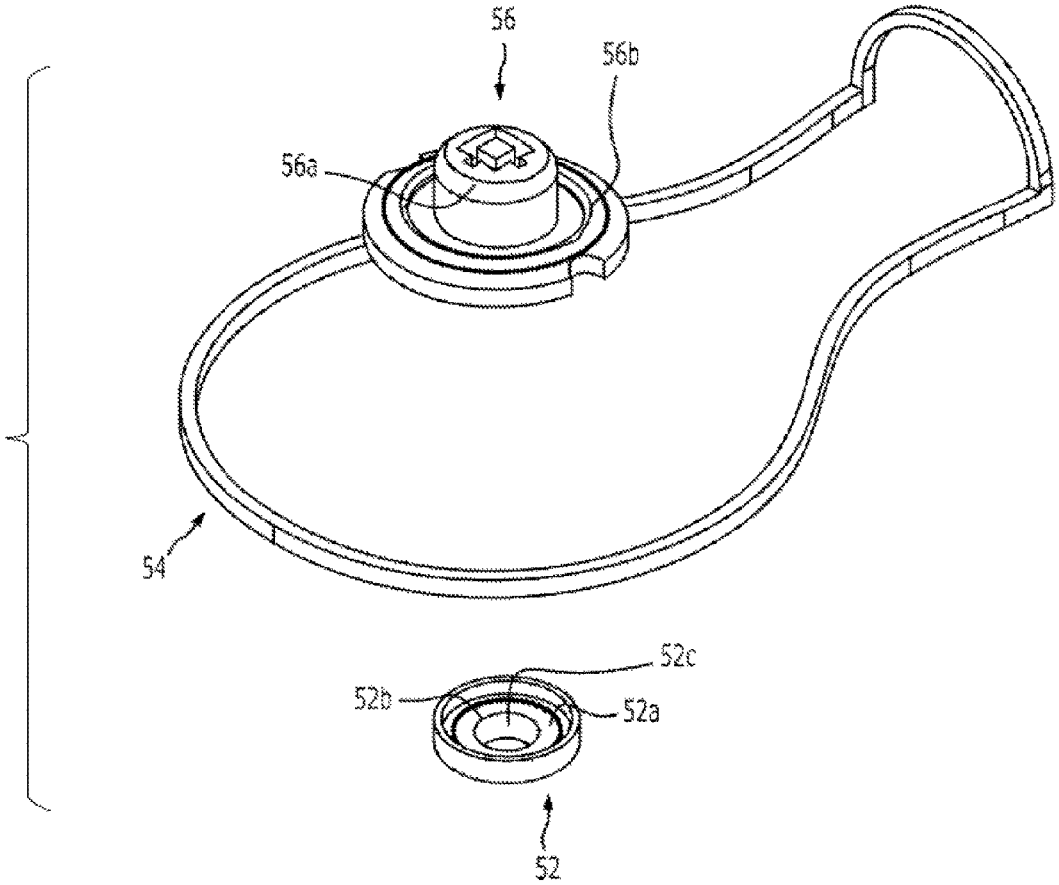
FIG. 3 is an appearance perspective view showing the structure of the sealing member which is the other main part of the present invention.
Figure 4:
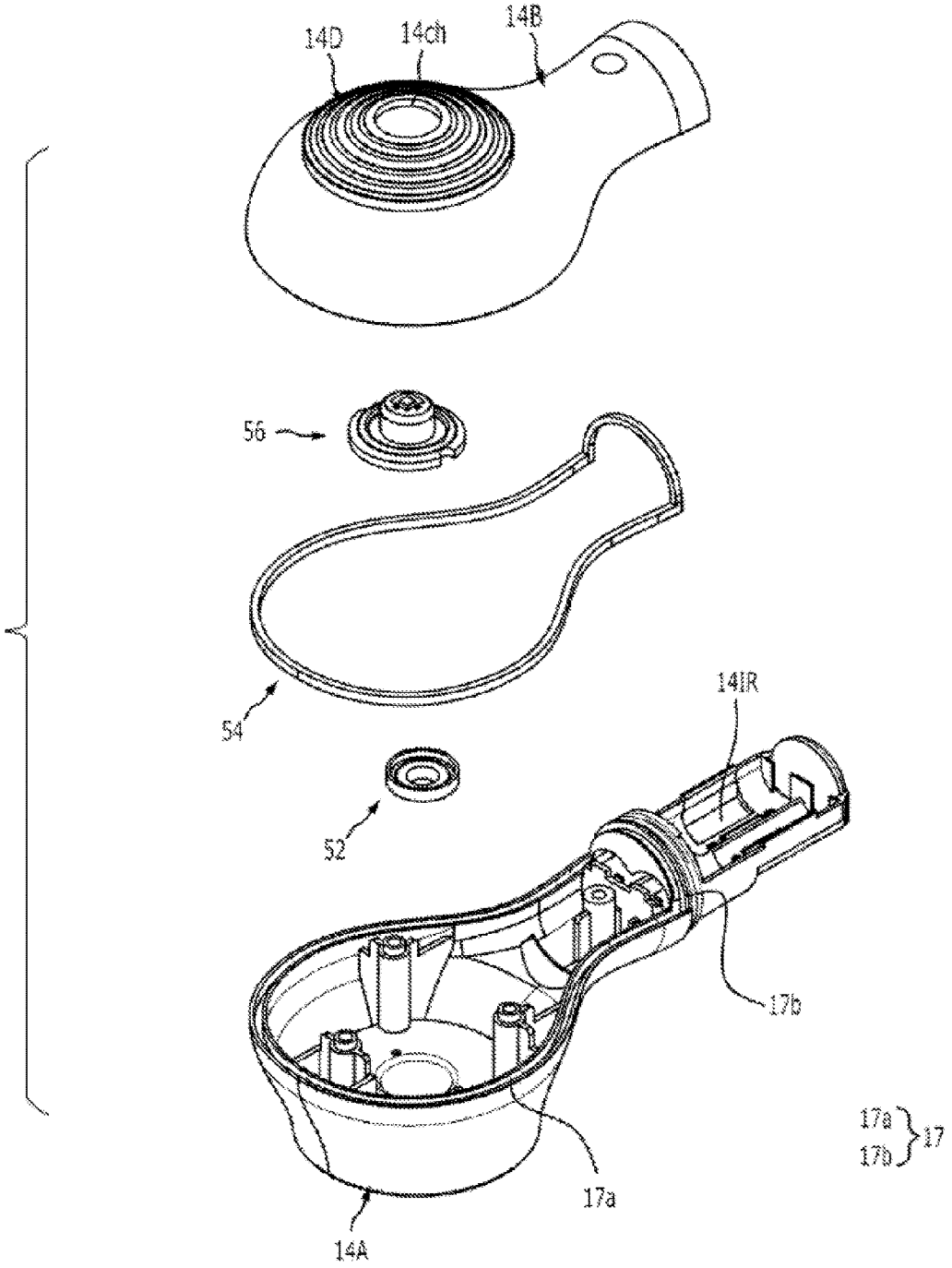
FIG. 4 is a disassembled perspective view of the sealing member and the case illustrated in FIG. 3.
Figure 5:
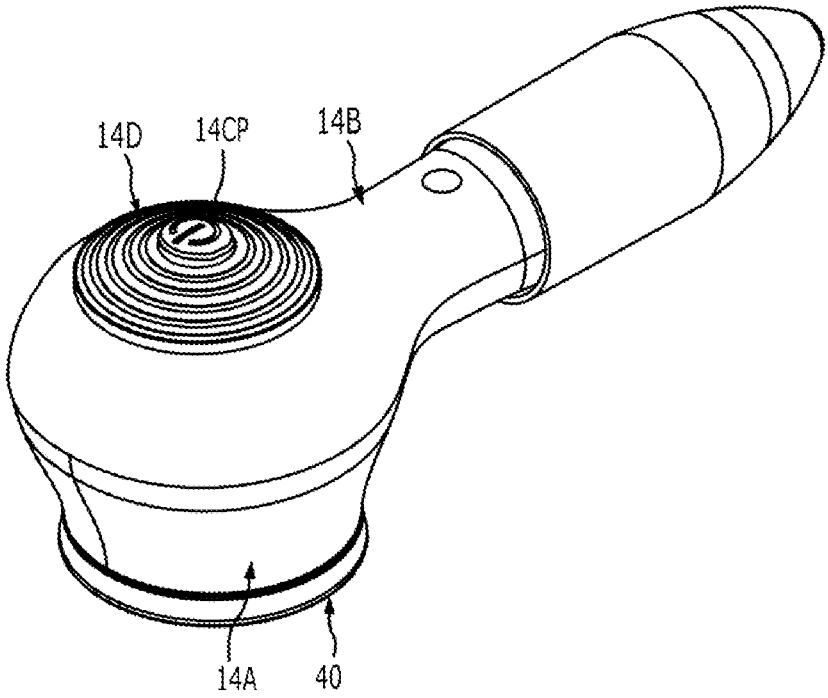
FIG. 5 is an appearance perspective view of the auto cleansing apparatus according to the invention.

The invention will now be described more fully hereinafter with reference to the accompanying drawings, in which exemplary embodiments thereof are shown.

Referring to the drawings, according to the embodiment of the auto cleansing apparatus of the invention, the position of the convex cam surface 22A1, 24A1 and the concave cam surface 22A2, 24A2 of a pair of parallel cams 20 is by turns changed by the drive unit 10 which is equipped inside the case 14 to generate the rotation power, and the rotor link 30 may be rotated as round trip rotation mode. The rotor plate 40 equipped with the cleansing member (the skin cleansing member) like the brush is connected the rotor link 30, and the skin care may be acquired while the rotor plate 40 may be rotated along the section between one direction and another direction as round trip rotation mode. And, the driving reference point may be balanced by a pair of the rotor arms 32 of the rotor link 30 and a pair of a first cam 20A and a second cam 20B for the round trip rotation of the rotor plate 40. Accordingly, the invention may have various advantages that the noise occurrence and so on may be prevented, the reliability of operation may be heightened and the lifetime may be more lengthened in comparison with the prior art.

A first case member 14A and a second case member 14B are configured to be interconnected with the combining means like the bolt. The case 14 may be configured with the first case member 14A and the second case member 14B. The capacity space part for having the driving assembly for the driving (round trip rotation) of the rotor plate 40 is equipped in the inner portion front side of the case 14 and the battery acceptor 14IR for having the battery is equipped in the internal rear side of the case 14.

Specifically, the first case member 14A has the capacity space part opened to the upper portion in the inner front portion and the battery acceptor 14IR in the inner rear portion. The battery 2 is installed in the battery acceptor of the first case member 14A. The front terminal part 4 is equipped in the front end of the battery acceptor 14IR and the rear terminal part 6 is equipped in the rear end of the battery acceptor. The battery installed at the battery acceptor 14IR can electrically connected to the front terminal part 4 and the rear terminal part 6. Moreover, the cyclic screw part is equipped at the outer periphery of the battery acceptor 14IR of the first case member 14A. The screw part of the ring-shaped inner periphery of the rear cover sleeve 14AR is combined to the screw part at the outer periphery of the batter acceptor 14IR so tha the rear cover sleeve 14AR surrounds the battery acceptor 14IR of the first case member 14A. The rear cover sleeve 14AR may be also the component of the first case member 14A.

Moreover, the first case member 14A has the sealing member seating groove 17 at the upper end portion arranged around the capacity space for the driving assembly and the battery acceptor 14IR. The sealing member seating groove 17 comprises the capacity space part ambient sealing member seating groove 17*a* and the battery acceptor front sealing member seating groove 17*b*. The capacity space part ambient sealing member seating groove 17*a* has the configuration wherein two align linear seating grooves are continued for the columnar seating groove when looking at the upper side of the first case member 14A, and the battery acceptor shear sealing member seating groove 17*b* is comprised of the semicircular shape seating groove structure. The sealing member seating groove 17 may be the packing seating groove in which the packing (in other words, the sealing member) of the rubber material is settled.

A plurality of coupling bosses extended along the top and bottom direction is provided in the capacity space part of the inner portion of the first case member 14A. The rotor link support boss 18 may be formed at the central position of the capacity space part of the first case member 14A. And the rotor link binding hole is formed in the rotor link support boss 18. The rotor link binding hole is perforated from the capacity space part to the bottom surface of the first case member 14A. Moreover, the concave groove part 18*a* is equipped at the bottom surface of the first case member 14A. The concave groove part 18*a* is arranged nearby the rotor link support boss 18.

The inner case 14C is installed in the capacity space of the first case member 14A. At this time, the inner case 14C may be formed by the front inner case 14C1 and the rear inner case 14C2. The front inner case 14C1 and the rear inner case 14C2 may be interconnected by the bolt and so on. The first cam 20A and the second cam 20B to be described below, the rotor link 30, the driving shaft 10*a* of drive unit 10 and driving gear 12 are installed inside the inner case 14C. The first cam 20A, the second cam 20B, the rotor link 30, the drive unit 10 and the driving gear 12 may be the driving assembly for driving the rotor plate 40 (for rotating the rotor plate 40 in the constant angular range as the round trip rotation). This driving assembly is installed in the inner case 14C. The inner case 14C is comprised of the rectangular box structure provided with the front wall, the rear wall, the upper surface portion and the bottom surface portion.

The drive unit supporting part 19 may be formed at the rear wall part of the inner case 14C, and the driving shaft inserting hole is equipped in the rear portion of the drive unit supporting part 19. Moreover, the fixing support piece may be formed at the circumference of the inner case 14C, and the combining means inserting hole facing the coupling boss of the first case member 14A is equipped in the fixing support piece. When the inner case 14C is placed in the capacity space part of the first case member 14A, it consists of the state that the combining means inserting hole formed on the fixing support piece of the inner case 14C is inserted in the coupling boss of the first case member 14A and the combining means (it may be the bolt, but for convenience, the bolt may be called as the combining means hereinafter) passes through the combining means inserting hole to be tightened to the coupling boss. And, the switch 11 fixing hook 14*ho* is equipped in the upper portion of the inner case 14C. Two switch fixing hooks 14*ho* facing each other are equipped in the upper side of the inner case 14C.

The rotor link support boss 18 is provided in the bottom surface of the inner case 14C. The rotor link support boss 18 is downwardly extended. And the rotor link rotation support hole connected from the inner surface of the inner case 14C to the outer surface of the inner case 14C is formed in the rotor link support boss 18. The rotor link support boss 18 provided at the bottom surface of the inner case 14C is inserted to be coupled inside the rotor link support boss 18 of the first case member 14A. When the inner case 14C is placed in the capacity space part of the first case member 14A, it consists of the state that the rotor link support boss 18 is inserted inside the rotor link support boss 18 of the first case member 14A. Moreover, the rotor link guide sleeve 15 is equipped inside the rotor link support boss 18 of the inner case 14C. And a pair of the rotor link guide holes 15*h* are equipped at the circumference of the rotor link guide sleeve 15. The rotor link guide holes 15*h* are penetrated from the inner periphery of the rotor link guide sleeve 15 to the outer periphery of the rotor link guide sleeve 15. A pair of the rotor link guide holes 15*h* are respectively equipped in both side positions of the length direction center line of the rotor link guide sleeve 15. In the invention, a pair of rotor link guide holes 15*h* are arranged at both side positions orthogonal to the longitudinal direction of the first case member 14A. In the meantime, the key provided at the outer periphery of the rotor link guide sleeve 15 is combined with the key groove provided at the rotor link support boss 18 of the bottom surface of the inner case 14C, the upper end of the rotor link guide sleeve 15 is supported by the upper stopping jaw provided in the inner case 14C. Accordingly, the rotor link guide sleeve 15 may be stably arranged in the internal space of the rotor link support sleeve of the inner case 14C. The rotor link guide sleeve 15 is not deviated from the rotor link support boss 18. Two rotor link guide holes 15*h* formed in the circumference of the rotor link guide sleeve 15 may be arranged in the internal space of the inner case 14C. Moreover, the axis supporting holes facing each other are equipped in the inner surface of the front wall and the rear wall of the inner case. The front side axis supporting hole and the rear side axis supporting hole face each other. Moreover, the front side axis supporting hole and the rear side axis supporting holes are respectively equipped at the left position and the right position of the inner space of the inner case 14C. The front side axis supporting hole and the rear side axis supporting holes are parallel each other.

The second case member 14B comprises the shape for covering the upper opening of the capacity space of the first case member 14A. The lower end portion of the second case member 14B is arranged in opposite direction to the upper end portion of the first case member 14A. The sealing member combining support groove 13 is equipped in the lower end portion of the second case member 14B. At this time, the sealing member combining support groove 13 of the second case member 14B is comprised of the capacity space part ambient sealing member combining support groove and the battery acceptor front sealing member combining support groove. When the user looks in the upper side of the second case member 14B, two align linear seating grooves are continued for the columnar seating groove and the battery acceptor front sealing member combining support groove is comprised the semicircular shape seating groove structure. The above-described sealing member combining support groove of the second case member 14B may face the sealing member seating groove 17 at top and bottom position of the first case member 14A. The sealing member combining support groove 13 of the second case member 14B may be the support groove in which the packing (in other words, the sealing member) of the rubber material is combined securely.

A plurality of coupling bosses may be formed at the inner portion of the second case member 14B. And the combining means inserting hole penetrated toward the outside (the upper side) within the second case member 14B is equipped in the respective coupling bosses. The respective coupling bosses and the respective combining means inserting holes of the second case member 14B meet with the respective coupling bosses and the respective combining means inserting holes provided in the first case member 14A. Moreover, the fixing support piece is provided at the circumference of the inner case 14C embedded in the inner capacity space of the first case member 14A. The combining means through-hole formed at the fixing support piece also meets with the combining means inserting hole of the first case member 14A and the combining means inserting hole of the second case member 14B. That is, the combining means inserting hole equipped in the coupling boss of the first case member 14A, the combining means inserting hole equipped in the coupling boss of the second case member 14B and the combining means through-hole of the inner case 14C meet at the same line along the top and the bottom direction.

Moreover, the switch hole 14*sh* is equipped in the second case member 14B. The switch hole 14*sh* is connected from the outer surface to the inner surface of the second case member 14B. The switch hole 14*sh* is the circular hole shape, it is equipped at the central position of the dome configuration portion of the second case member 14B. Moreover, the concave groove part is equipped in the inner side of the second case member 14B. The concave groove part is arranged nearby the switch hole 14*sh*. The concave groove part is comprised of the annular recess form. Moreover, the secondary case cover 14D of dome shape is fixed at the upper side of the second case member 14B with the combining means such as bolt etc. At this time, the switch cap combining hole 14Dch penetrated toward the inner side form the outer side is equipped in the secondary case cover 14D. The switch cap combining hole 14Dch has the circular hole structure in order that it may be corresponded to the switch hole 14*sh* of the second case member 14B.

Therefore, when the combination means such as bolt is inserted in the combination means through-hole and the second case member 14B and the combination means through-hole provided at the fixing support piece of the inner case 14C, and said combination means is tightened with the combination means inserting hole in the combination boss provided in the capacity space of the first case member 14A, the first case member 14A and the second case member 14B may be combined each other at the lower position and the upper position. The case 14 may be formed with the first case member 14A and the second case member 14B. At the same time, the inner case 14C may be equipped in the inner side of the case 14.

As described above, the drive unit 10, the driving gear 12, the first cam 20A, the second cam 20B and the rotor link 30 organize the driving assembly for rotating reciprocally the rotor plate 40, in other words, the rotor plate 40 rotating for the skin cleansing. The first cam 20A, the second cam 20B, the rotor link 30, and the driving shaft 10*a* and the driving gear 12 of the drive unit 10 are installed inside the inner case 14C.

In the present invention, the drive unit 10 comprises motor and the driving shaft 10*a* comprises the motor shaft of motor. Hereinafter for convenience motor and motor shaft may be called the drive unit 10 and the driving shaft 10*a*. This drive unit 10 is combined in the drive unit supporting part which is more extended from the outer surface of the rear wall of the inner case 14C toward the rear direction and has the structure of sleeve. The driving shaft 10*a* of the drive unit 10 is inserted in the driving shaft inserting hole formed in the rear wall part of the inner case 14C to be installed in the inner case 14C. The drive unit 10 may be provided with the power source from the battery installed in the case 14 so that the driving shaft 10*a* may be rotated.

The first case member 14A has the capacity space opened to the upper portion in the inner front position and the battery acceptor in the inner rear position. The battery is installed in the battery acceptor of the first case member 14A. The front terminal part 4 is equipped in the front end of the battery acceptor and the rear terminal part 6 is equipped in the rear end of the battery acceptor. The battery installed in the battery acceptor may be electrically contacted to the front terminal part 4 and the rear terminal part 6.

The driving gear 12 is equipped in the driving shaft 10*a* of the drive unit. The driving gear 12 is coaxially combined in the driving shaft 10*a* of the drive unit 10. The driving gear 12 rotates according to the rotation of the driving shaft 10*a*. At this time, in the invention, the base part of the driving gear 12 is coaxially connected to the driving shaft 10*a* and the front part of the driving gear 12 is rotatably coupled in the support boss equipped in the inner side of the front wall of the inner case 14C. The gear shaft equipped in the central part of the driving gear 12 is connected to the driving shaft 10*a* of the drive unit 10 by the connecting means such as the coupler and so on. And, the front end part of the gear shaft is rotatably coupled in the support boss equipped in the inner side of the front wall of the inner case 14C. Accordingly, the driving gear 12 may be rotated according to the rotation of the driving shaft 10*a*.

The switch 11 is fixed with the switch 11 fixing hook 14*ho* equipped in the upper side of the inner case 14C. The switch 11 of the rectangular shape is inserted between two of the fixing hooks 14*ho* which are aligned each other. The periphery and the top end part of the switch 11 may be supported by the fixing hook 14*ho* so that the switch 11 may be maintained at the state steadily fixed to the upper end of the inner case 14C. In the invention, the switch 11 is comprised of the tact switch including the switching button in the upper portion and the switch 11 is connected to the drive unit 10. If the switching button of the switch 11 is pressed down, the power source of the battery is applied at the drive unit 10 and the driving shaft 10*a* rotates. The driving gear 12 may be rotated if the driving shaft 10*a* rotates. Specifically, the drive unit 10 is electrically connected in the terminal part equipped in the case 14 and the switch 11 is electrically connected in the drive unit 10. If the switching button of the switch 11 is pressed, the driving shaft 10*a* of the drive unit 10 rotates and the driving gear 12 is rotated. And if the pressing state of the switching button of the switch 11 is dissolved, the rotation of the driving shaft 10*a* of the drive unit 10 is stopped and the rotation of the driving gear 12 is stopped. The invention includes a pair of first cams 20A and the second cam 20B. The first cam 20A and the second cam 20B are installed in the inner case 14C.

The first cam 20A and the second cam 20B have the cam shaft 20A in the central portion and the gear 20*cg* in the outer periphery. Both end parts of the cam shaft 20*cs* of the first cam 20A is rotatably coupled in the first front side axis supporting hole and the first back side axis supporting hole which are respectively provided at the inner surfaces of the front wall and the rear wall of the inner case 14C. And, both end parts of the cam shaft 20*cs* of the second cam 20B is rotatably coupled in the second front side axis supporting hole and the second back side axis supporting hole which are respectively provided at the inner surfaces of the front wall and the rear wall of the inner case 14C. The first cam 20A and the second cam 20B are respectively arranged at the left position and the right position in the inner case 14C. The left position and the right position intersect the longitudinal direction of the inner case 14C. The first cam 20A and the second cam 20B are parallel each other. When the user looks into the upper side of the inner case 14C, the first cam 20A and the second cam 20B are aligned at both sides. Moreover, the respective gears 20*cg* at the outer periphery of the first cam 20A and the second cam 20B are commonly combined with the gear of the driving gear 12. The rotation center part of the driving gear 12 is coaxially combined in the driving shaft 10*a* of the drive unit 10.

At this time, the first cam 20A and the second cam 20B have cam side 22, 24 in at least one side (the rear side) among both sides (the front side and the rear side). Cam side 22, 24 are comprised of concave cam side 22A2, 24A2 and convex cam side 22A1, 24A1. The concave cam side 22A2, 24A2 and the convex cam side 22A1, 24A1 are configured to be continued. The first convex cam side 22A1 of the first cam 20A may be the structure relatively more protruded to forward and backward thickness direction of the first cam 20A and the first concave cam side 22A2 may be the structure relatively more dented to forward and backward thickness direction of the first cam 20A. Also, the second convex cam side 24A1 of the second cam 20B may be the structure relatively more protruded to forward and backward thickness direction of the second cam 20B and the second concave cam side 24A2 may be the structure relatively more dented to forward and backward thickness direction of the first cam 20B. But the first convex cam side 22A1 of the first cam 20A is arranged in the position which is sideward align of the second concave cam side 24A2 of the second cam 20B, and the first concave cam side 22A2 of the first cam 20A is arranged in the position which is sideward align of the second convex cam side 24A1 of the second cam 20B.

While the first cam 20A and the second cam 20B rotate with the rotatory power of the drive unit 10, the concave cam side 22A2 and the convex cam side 22A of the first cam 20A operate so that the position be by turns changed with the convex cam side 24A1 and the concave cam side 24A2 of the second cam 20B. That is, the gear of the outer periphery of the second cam 20B and the first cam 20A is commonly engaged in the driving gear 12. If the driving gear 12 rotates, the first cam 20A and the second cam 20B rotate toward the same direction. The first convex cam side 22A1 of the first cam 20A is arranged in the position which is sideward align of the second concave cam side 24A2 of the second cam 20B, and the first concave cam side 22A2 of the first cam 20A is arranged in the position which is sideward align of the second convex cam side 24A1 of the second cam 20B. In accordance with the rotation of the first cam 20A and the second cam 20B, when the first convex cam side 22A1 of the first cam 20A rotates toward the upper position to move ahead toward the rear direction of the case 14, the second convex cam side 24A2 of the second cam 20B rotates toward the lower position to move ahead toward the rear direction of the case 14. On the contrary, in accordance with the rotation of the first cam 20A and the second cam 20B, when the first convex cam side 22A1 of the first cam 20A rotates toward the lower position to move ahead toward the rear direction of the case 14, the second convex cam side 24A1 of the second cam 20B rotates toward the upper position to move ahead toward the rear direction of the case 14.

In other words, while the first convex cam side 22A1 and the first concave cam side 22A2 of the first cam 20A moves along the circular direction in accordance with the rotation of the first cam 20A, the positions of the first convex cam side 22A1 and the first concave cam side 22A2 may be changed so that the first convex cam side 22A1 may rotate toward the upper position to move ahead toward the rear direction of the case 14, and on the other hand, while the second concave cam side 24A2 and the second convex cam side 24A1 of the second cam 20B moves along the circular direction in accordance with the rotation of the second cam 20B, the positions of the second concave cam side 24A2 and the second convex cam side 24A1 may be changed so that the second convex cam side 24A1 may rotate toward the lower position to move ahead toward the rear direction of the case 14. As described above, if the first convex cam side 22A1 of the first cam 20A rotates toward the upper position to move ahead toward the rear direction of the case 14, the second convex cam side 24A2 of the second cam 20B rotates toward the lower position to move ahead toward the rear direction of the case 14. On the contrary, if the first convex cam side 22A1 of the first cam 20A rotates toward the lower position to move ahead toward the rear direction of the case 14, the second convex cam side 24A1 of the second cam 20B rotates toward the upper position to move ahead toward the rear direction of the case 14. At this time, the first convex cam side 22A1 and the first concave cam side 22A2 comprise the cam side 22 of the first cam 20A, and the second convex cam side 24A1 and the second concave cam side 24A2 comprise the cam side 24 of the first cam 20B. Preferably, these cam sides 22, 24 is formed of the curved part which has the surface curvature.

The rotor link 30 is placed along the vertical direction in the inner case 14C. The rotor link 30 may rotate in accordance with the rotation of the rotor center shaft 34. The rotor link 30 comprises the rotor center shaft 34 and a pair of the rotor arms 32 arranged at both sides of the rotor center shaft 34.

Figure 6:
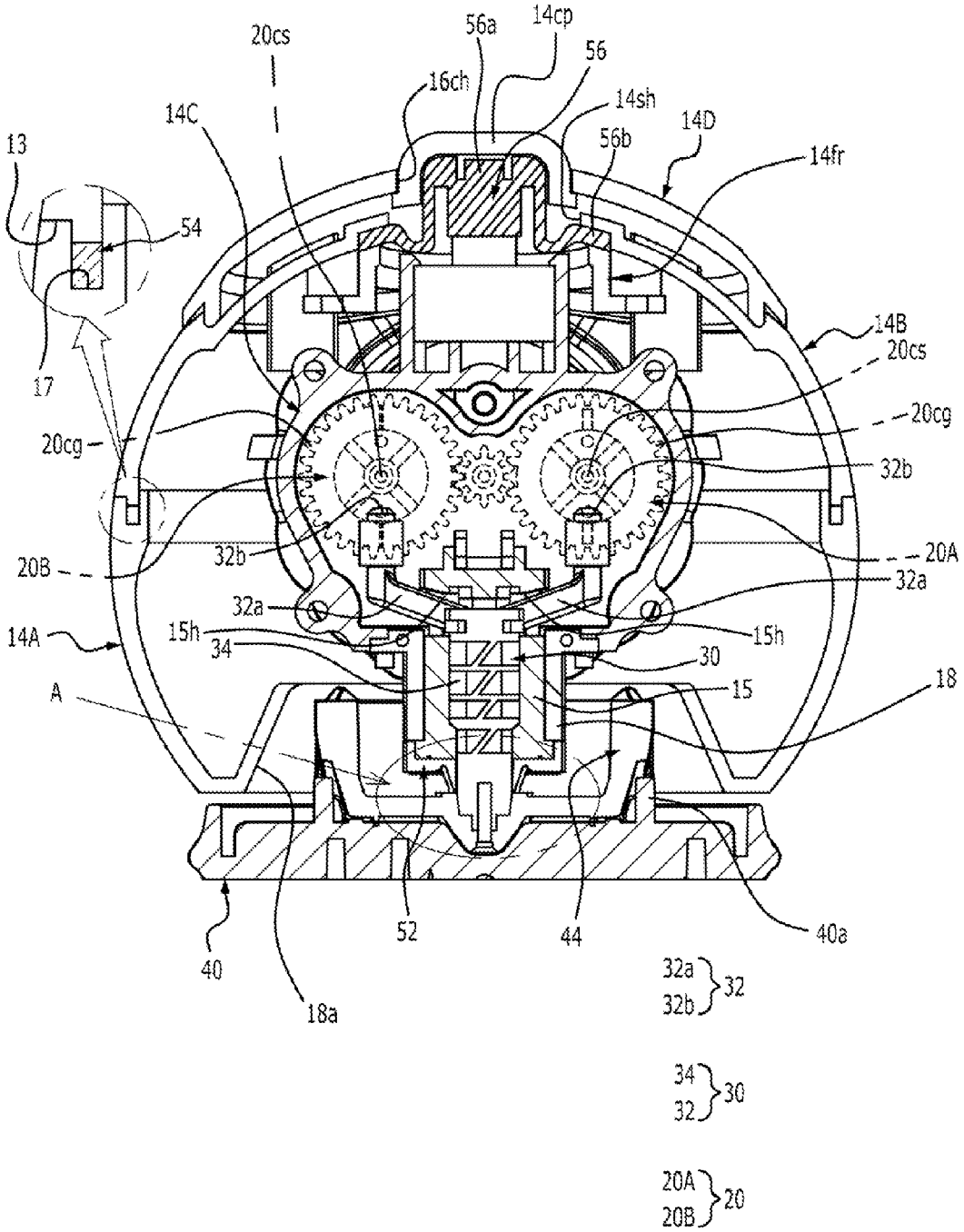
FIG. 6 is the cross-sectional view of 5.
Figure 7:
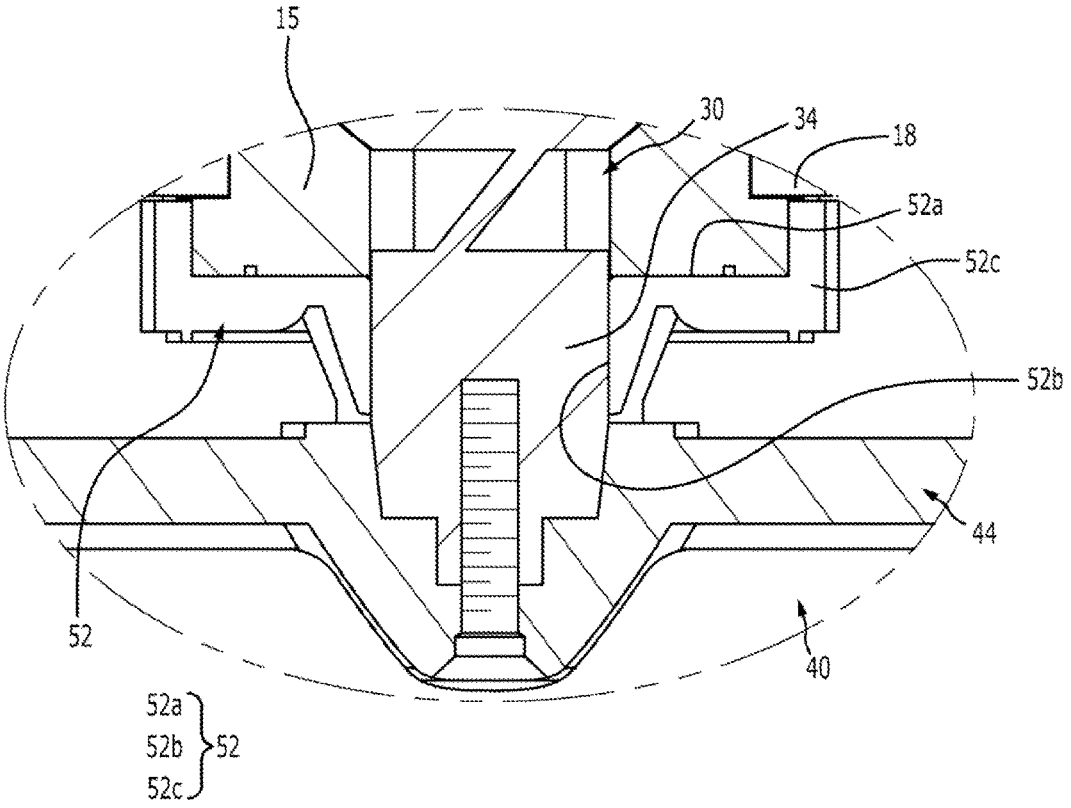
FIG. 7 is the expanded cross-sectional view of A part of FIG. 6.
Figure 8:
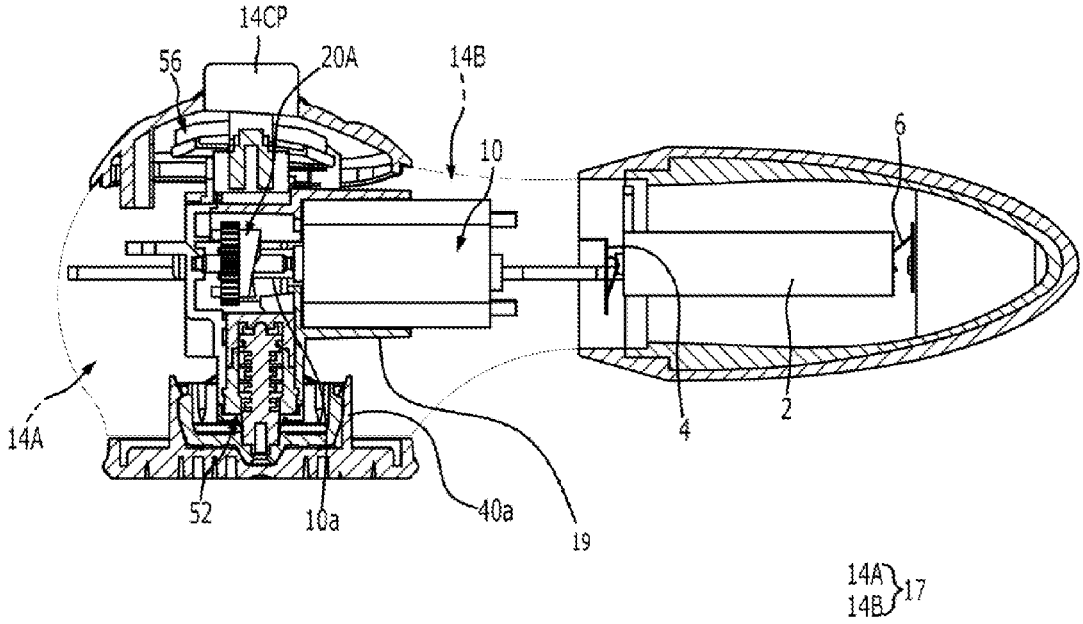
FIG. 8 is the side sectional view of FIG. 5.
Figure 9:
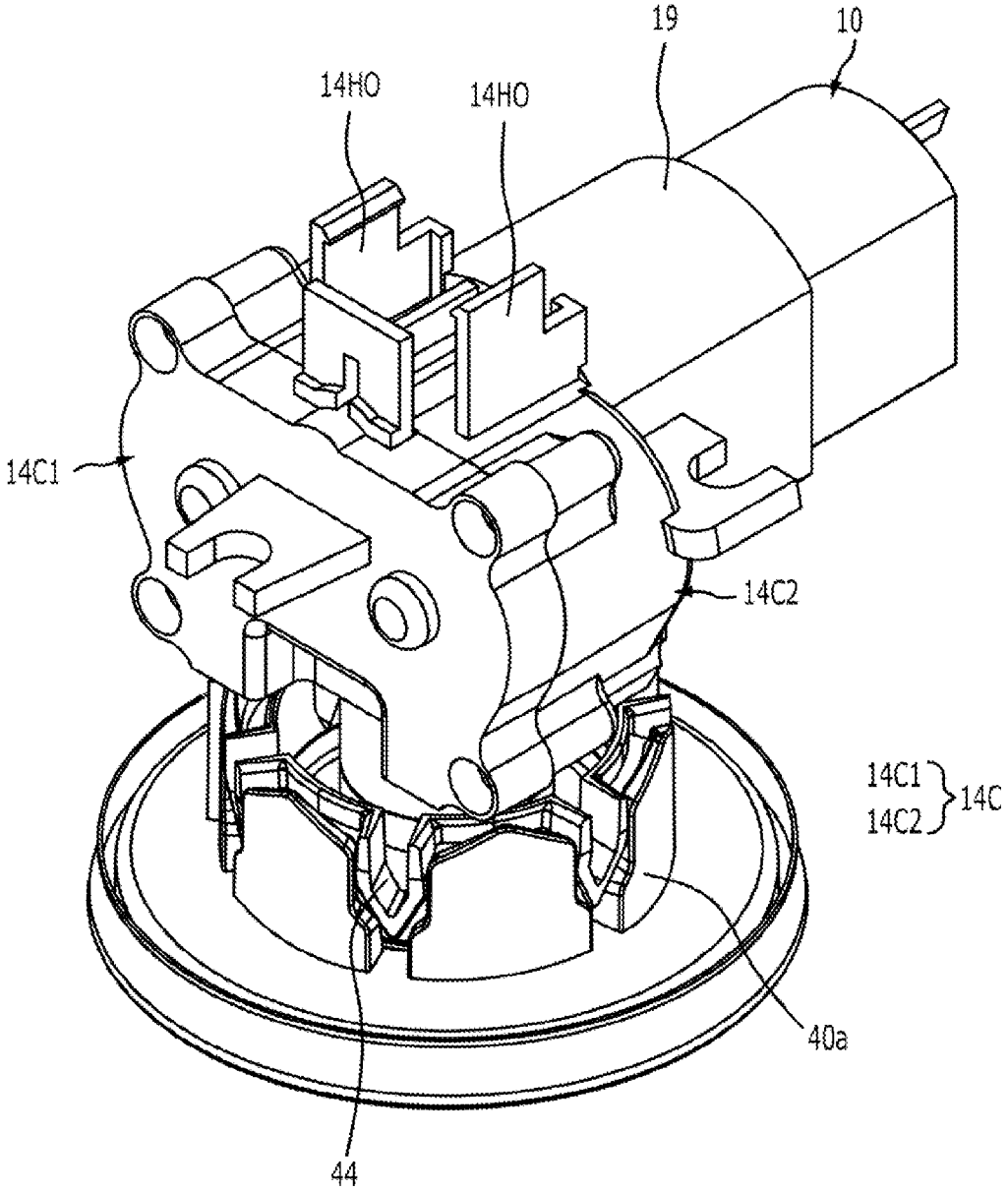
FIG. 9 is an appearance perspective view showing the inner case, the drive unit and the rotor plate which are the main part of the present invention.

The rotor center shaft 34 called the configuration of the rotor link 30 is rotatably installed at the rotor link support part equipped inside the case 14. As shown in FIG. 6, the rotor link support part of the case 14 is comprised of the rotor link support boss 18 extended to the bottom surface of the inner case 14C and the rotor link guide sleeve 15 installed in the rotor link rotation support hole of the rotor link support boss 18. The rotor center shaft 34 of the rotor link 30 is rotatably installed in the rotor link guide sleeve 15. Accordingly, when the rotor link 30 rotates in the case 14 with the rotor center shaft 34 as the rotation center, a pair of the rotor arms 32 provided at the rotor link 30 may be rotated along the columnar trajectory and the rotor arms 32 may go forward and backward direction of the case 14. When the upper side of the case 14 is observed, two rotor arms 32 may repeat the forward and backward movement along the front direction and the rear direction of the case 14 with the rotor center shaft 34 as the rotation center. Two rotor arms 32 may repeat the forward and backward movement of the seesaw type. At this time, the hanging support projection is equipped in the inner periphery of the rotor link guide sleeve 15. The hanging support projection in the rotor link guide sleeve 15 may support one disc piece among a plurality of the disc pieces equipped in the outer periphery of the rotor center shaft 34 along the longitudinal direction by the constant interval.

Figure 10:
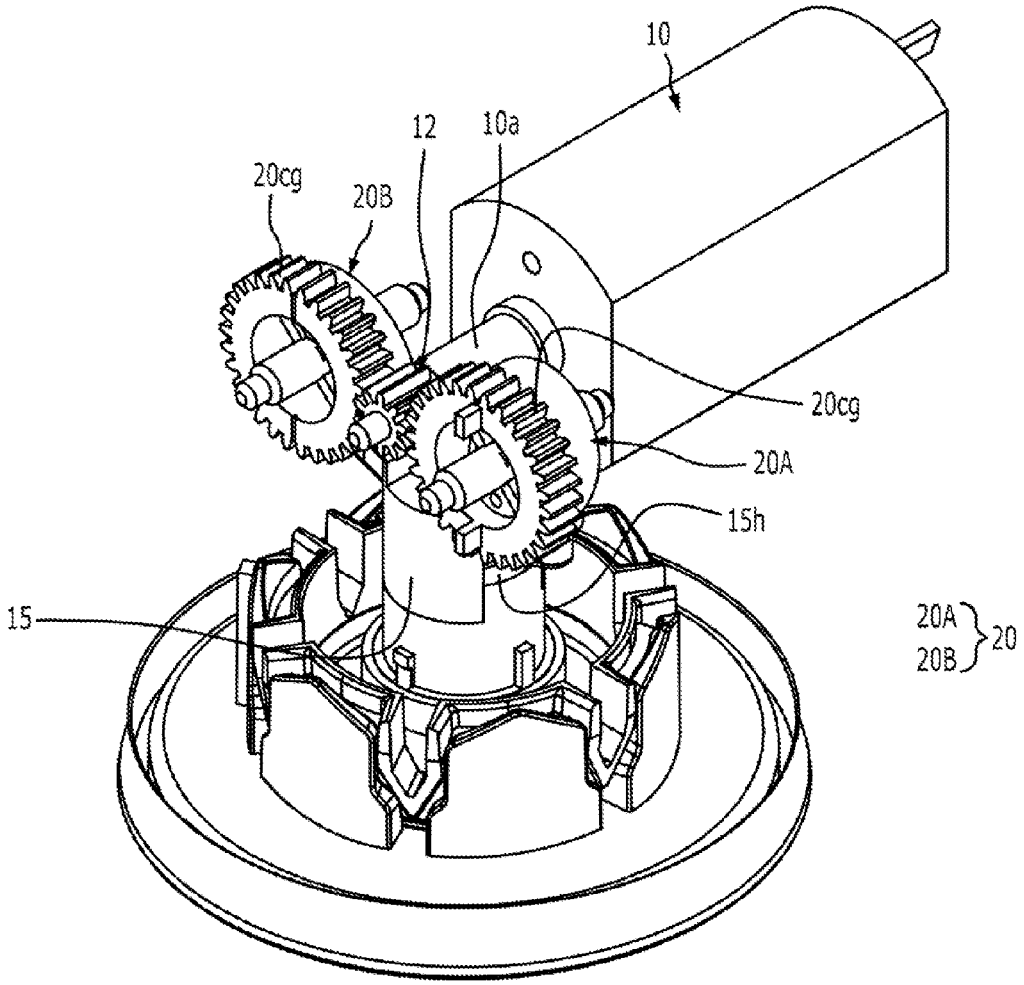
FIG. 10 is a perspective view showing the first cam, the second cam and the driving gear installed at the inner case of FIG. 9.
Figure 11:
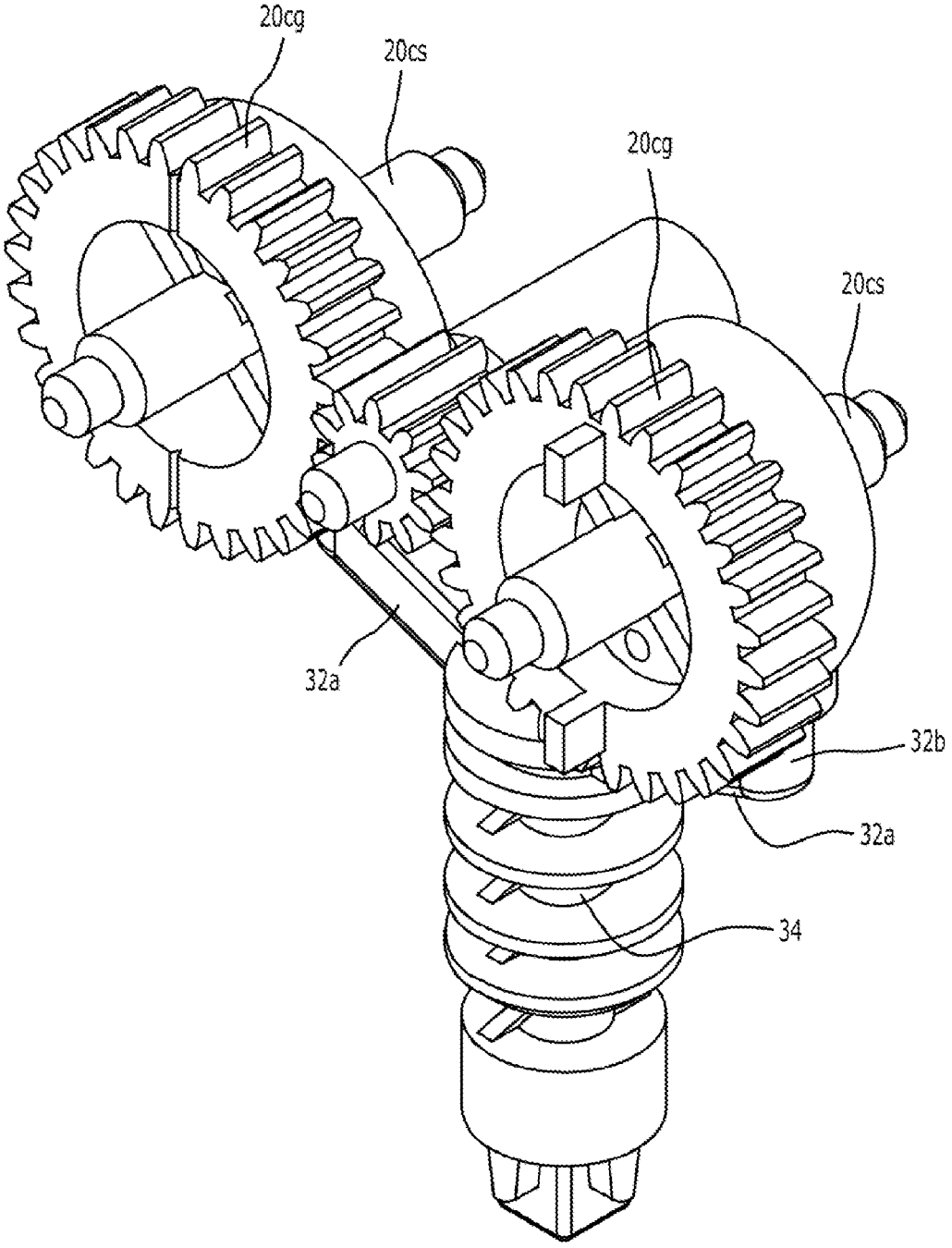
FIG. 11 is a perspective view showing the structure of the first cam, the second cam, the driving gear and the rotor link illustrated in FIG. 10.
Figure 12:
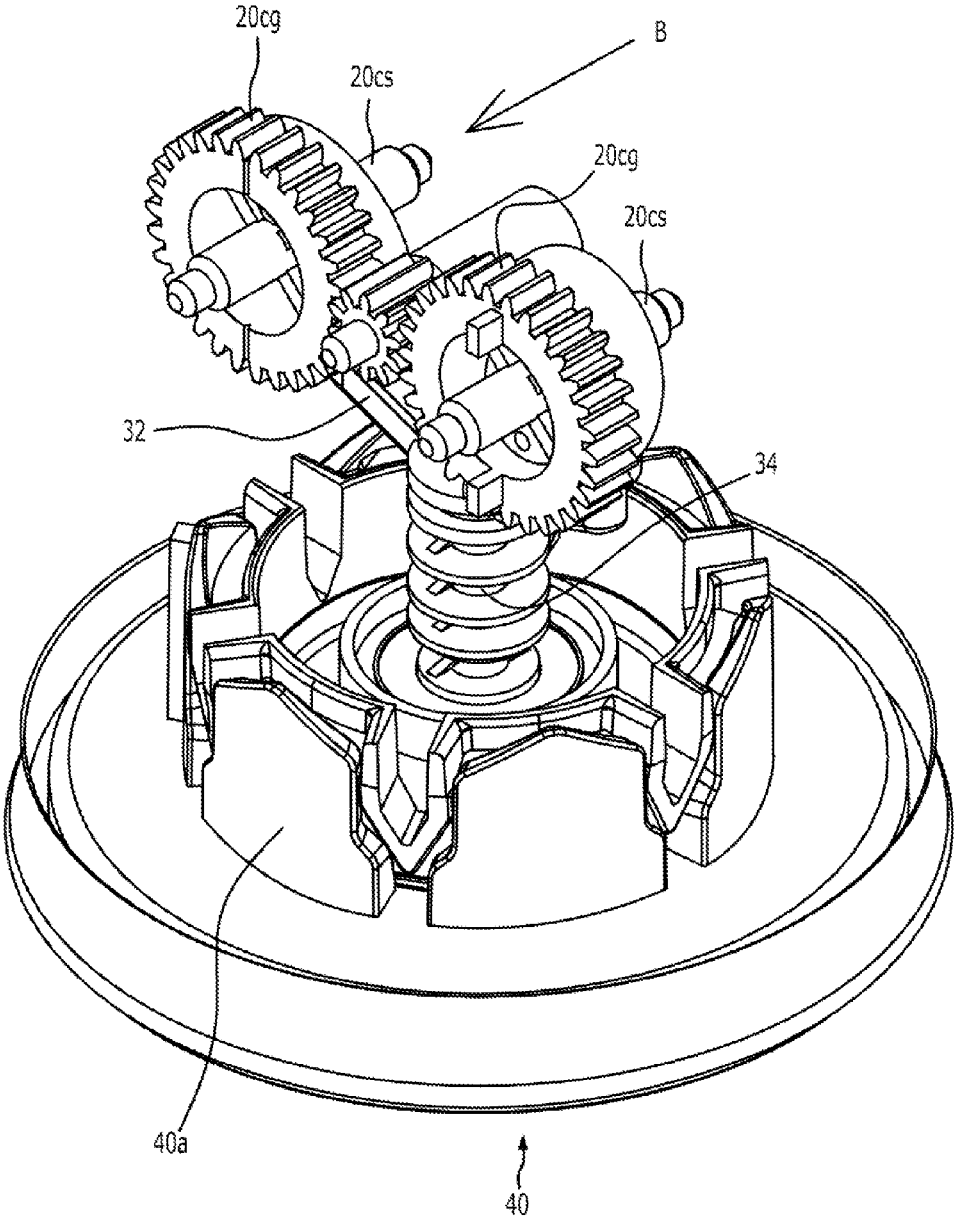
FIG. 12 is a perspective view showing the coupling structure between the rotor plate and the rotor link.
Figure 13:
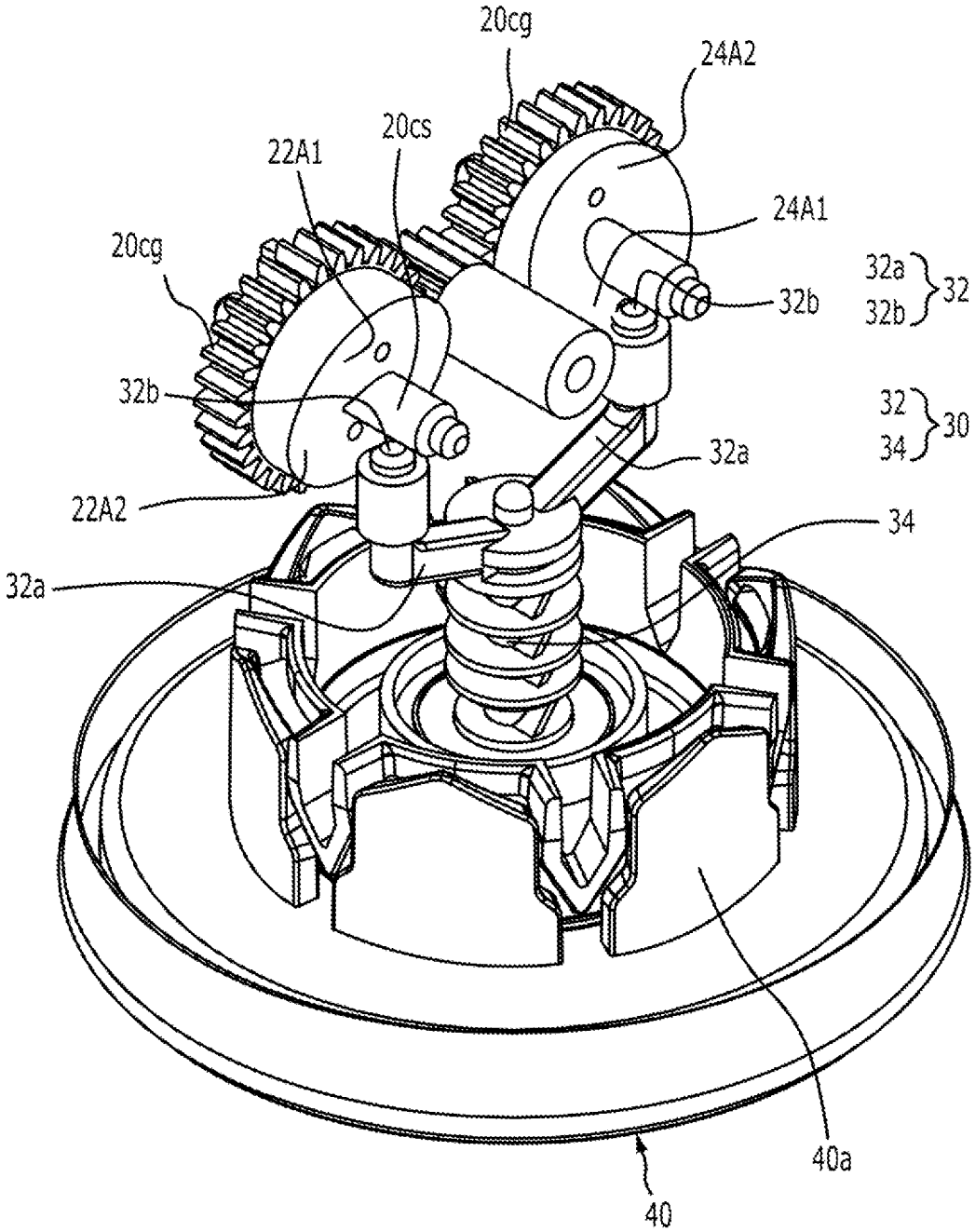
FIG. 13 is B direction perspective view of FIG. 12.

A pair of bridge pieces 32*a* are equipped at both sides of the rotor center shaft 34 at the slanting state. A driving force transformer pin 32*b* is respectively equipped at the upper end portion of each bridge piece 32*a*. The bridge pieces 32*a* and the driving force transformer pins 32*b* organize the rotor arm 32. At this time, as shown in FIG. 6 and FIG. 10, a pair of the rotor link guide holes 15*h* facing each other at opposite directions are equipped in the rotor link guide sleeve 15 of the case 14 (exactly, the inner portion of the inner case 14C) in which the rotor center shaft 34 of the rotor link 30 is rotatably supported. A pair of the bridge pieces 32*a* comprising a pair of rotor arms 32 of both sides of the rotor link 30 pass through the rotor link guide holes 15*h* from the inner portion of the rotor link guide sleeve 15. When the rotor link 30 rotates in the case 14 with the rotor center shaft 34 as the rotation center, the bridge pieces 32*a* provided at the respective rotor arms 32 may repeat the forward and backward rotation within the rotation range of the respective rotor link guide holes 15*h*.

Each driving force transformer pin 32*b* comprising each rotor arm 32 of the rotor link 30 is arranged in the position which may be contacted with the cam sides 22, 24 provided at a pair of the cams 20. That is, a pair of rotor arms 32 are arranged in the position which may be contacted with the convex and the concave cam sides provided at the rear surface of the first cam 20A and the second cam 20B, in other words, the first convex cam side 22A1, the first concave cam side 22A2, the second convex cam side 24A1 and the second concave cam side 24A2. Moreover, the buffer member 36 of the soft material (for example, silicone) is equipped in each rotor arm 32 of the rotor link 30. The buffer member 36 is configured to be contacted with the cam sides 22, 24 of the first cam 20A and the second cam 20B. The bond support groove of the concave groove type may be formed at the outer periphery of the driving force transformer pin 32*b* comprising the rotor arm 32. And the buffer member 36 has the structure being made of the tube type in which it has the hollow in the inner portion. The buffer member 36 may be inserted in the bond support groove of the driving force transformer pin 32*b*. Therefore, each buffer member 36 of the soft material (silicone or rubber etc) which is equipped in each rotor arm 32 of the rotor link 30 is arranged in the position which may be contacted with the first convex cam side 22A1 and the first concave cam side 22A2 of the first cam 20A and the second convex cam side 24A1 and the second concave cam side 24A2 of the second cam 20B. As a result, when, among a pair of the rotor arms 32 of the rotor link 30, the rotor arm 32 on one side is arranged in the position which is contacted with the first concave cam side 22A2 of the first cam 20A, the rotor arm 32 on the other side is arranged in the position which is contacted with the second convex cam side 24A1 of the second cam 20B, on the other hand, when the rotor arm 32 on one side is arranged in the position which is contacted with the first convex cam side 22A1 of the first cam 20A, the rotor arm 32 on the other side is arranged in the position which is contacted with the second concave cam side 24A2 of the second cam 20B.

The rotor plate 40 is combined in the rotor link 30 and it is arranged in the front side external base position of the case 14.

The rotor plate 40 is comprised of the circular plate shape. A plurality of the combining holes are equipped in the bottom surface of the rotor plate 40. The cleansing member like the brush for the skin cleansing is inserted in the cleansing member the combining hole of the rotor plate to be fixed. If the rotor plate 40 rotates, the cleansing member rotates and the cleansing function of the skin surface and so on may be performed. The rotor plate 40 and the brush together rotate and the cleansing function for the skin may be performed. Moreover, multiple connection plate support pieces 40*a* are equipped in the upper side of the rotor plate 40 along the columnar direction to the constant interval, and the protrusion piece support groove are equipped among each connection plate support piece 40*a*. Moreover, the bond support projection may be equipped in the inner periphery of the connection plate support piece 40*a*. The connection plate 44 arranged in the connection plate support piece 40*a* is equipped in the upper side of the rotor plate 40. At this time, the connection plate 44 is comprised of the cap shape opened to the upper portion, multiple protrusion pieces are formed at the upper side of the connection plate 44 along the columnar direction, and the hanging jaw is provided among each protrusion piece. In the state that the connection plate 44 is kept in the inner portion of the connection plate support piece 40*a* provided at the upper sided of the rotor plate 40, each protrusion piece of the connection plate 44 is inserted in the protrusion piece support groove between the connection plate support piece 40*a*, and the hanging jaw equipped at the outer periphery of the connection plate 44 hang on the lower position of the bond support projection provided at the inner periphery of each connection plate support piece 40*a*. The structure in which the connection plate 44 is joined in the rotor plate 40 may be taken by assembling like the above. At this time, the combining means inserting hole equipped in the central part of the connection plate 44 and the combining means joint hole equipped in the lower end portion of the rotor center shaft 34 of the rotor link 30 meet each other.

By connecting the rotor plate 40 to the rotor center shaft 34 of the rotor link 30 with combining means, the rotor plate 40 may be equipped in the front side external base position of the case 14. In the invention, the connection plate 44 is joined in the upper side of the rotor plate 40. If, in the state that the combining means inserting hole formed in the central part of the connection plate 44 and the combining means joint hole equipped in the lower end portion of the rotor center shaft 34 of the rotor link 30 are arranged to face each other, said combining means (for example, the bolt etc as described above) passes through the combining means inserting hole of the central part of the connection plate 44 and is joined in the combining means joint hole open to the lower end of the rotor center shaft 34 provided at the rotor link 30 such as tightening the screw, the connection plate 44 may be united with the rotor link 30. And the lower end portion of the rotor center shaft 34 provided at the rotor link 30 is exposed outside the front lower end portion of the case 14. If the connection plate 44 is arranged outside the front lower end portion of the case 14, and in this state, the rotor plate 40 is joint with the connection plate 44, the structure in which the rotor plate 40 is arranged in the front external base position of the case 14 may be taken. At this time, because the concave groove part 18*a* is equipped in the outside of the front lower portion of the case 14 and the concave groove part 18*a* is arranged in the surroundings of the rotor link support boss 18, the connection plate 44 and the connection plate support piece 40*a* provided on the upper side of the rotor plate 40 is embedded in the concave groove part formed at the front lower side of the case 14.

Moreover, in the present invention, the driving unit 10, the cam 20 and the rotor link 30 may organize the driving assembly for driving the rotor plate 40. The case 14 has the capacity space for accommodating the driving assembly. The rotor link 30 is rotatably kept in the rotor link support portion provided in the case 14. The lower end portion of the rotor link 30 kept in the rotor link support portion is connected to the rotor plate 40 by the combining means. The sealing member 52 is allowed between the rotor link support portion and the rotor plate 40. The case 14 includes the first case member 14A equipped with the driving assembly capacity space and the second case member 14B for covering the upper portion of the first case member 14A. The sealing member 54 is allowed between the binding site of the first case member 14A and the second case member 14B. The switch 11 turning on and off the operation of the drive unit 10 may be provided at the case 14, and the sealing member 56 for the hermetic sealing with the outside is allowed between the binding site of the case 14 and the switch 11.

The sealing member 52 equipped in the connection part between the rotor plate 40 and the rotor link 30 may be referred to for convenience a first sealing member 52. The first sealing member 52 comprises the sealing sleeve part of the disc shape which has the closed loop type sealing sleeve part extended to the bottom surface at the central part, the sealing combining hole 52*b* which is equipped in the sealing sleeve part and is connected to top and bottom of the sealing plate 52*a*, and the ambient sealing piece 52*c* of the closed loop type extended to the upper side of the sealing plate 52*a*.

Some of the rotor center shaft 34 of the rotor link 30 provided in the case 14 is exposed to the outside of the rotor link support boss 18 provided in the front section of the case 14. The first sealing member 52 is inserted in the exposed outer periphery of the rotor center shaft 34. Some outer periphery nearby the lower end of the rotor center shaft 34 provided at the rotor link 30 is protruded to the position which is lower than the lower end of the rotor link support boss 18 protruded to the outside of the front bottom of the case 14. The sealing combining hole 52*b* equipped in the central part of the sealing plate 52*a* of the first sealing member 52 is combined in the outer periphery of the rotor center shaft 34 of the rotor link 30 protruded to the bottom surface of the case 14. Moreover, the rotor link support boss 18 positioned at the bottom surface of the inner case 14C is combined in the rotor center shaft combining hole of the first case member 14A forming the case 14. Some part of the outer periphery nearby the lower end of the rotor link support boss 18 is exposed to the outside of the rotor center shaft combining hole of the first case member 14A. In the state that the first sealing member is combined with the rotor center shaft 34 of the rotor link 30 by the sealing combining hole 52*b*, the closed loop type ambient sealing piece 52*c* adheres closely to the lower end of the rotor link support boss 18 and the outer periphery of the rotor link guide sleeve 15 as well as the sealing plate 52*a* adheres closely the lower end of the rotor link guide sleeve 15 provided at the rotor link 30. At this time, the first sealing member 52 is comprised of the material with the sealing property like the rubber in which the elasticity cohesive power. Therefore, the sealing state may be maintained effectively. The sealing state may mean that the binding part between the case 14 and the rotor link 30 may be blocked with the outside. And due to this, there is no case that the external water penetrates between the binding part between the case 14 and the rotor link 30.

The sealing member 54 provided between the binding part of the first case member (14A) and the second case member 14B may be the second sealing member 54. The second sealing member 54 comprises the capacity space ambient sealing part, and the battery acceptor front sealing part connected to the capacity space ambient sealing part. When the first case member 14A is observed at the upper side, the capacity space ambient sealing part is made of the seating groove combining sealing part of the columnar shape and two linear sealing parts continued for the seating groove combining sealing part. The battery acceptor front sealing part is comprised of the half circle form wherein both of the lower end portions are connected with two linear sealing parts.

Therefore, said second sealing member 54 is seated in the capacity space ambient sealing member seating groove 17*a* and the battery acceptor front sealing member seating groove 17*b* formed on the upper end of the first case member 14A. And, in order to cover the capacity space of the first case member 14A, when the second case member 17B is mounted on the upper end of the first case member 14A, said second sealing member 54 is also seated in the capacity space ambient sealing member seating groove 17*a* and the battery acceptor front sealing member seating groove 17*b* formed on the lower end of the second case member 14B. In this state, if the second case member 14B is assembled with the first case member 14A by the combining means (for example, the bolt etc), the sealing state between the combining part of the first case member 14A and the second case member 14B while the second sealing member 54 is tightly pressed between the combining part of the first case member 14A and the second case member 14B. Accordingly, there is no case that the external foreign substance penetrates between the combining part of the first case member 14A and the second case member 14B.

The sealing member 56 for sealing hermetically between the combining part of the case 14 and the switch 11 with the outside may be the third sealing member 56. The third sealing member 56 includes the switch sealing part 56*a* which may cover the switch 11 equipped in the inner case 14C of the case 14 at the upper position, and the expansion sealing part 56*b* which is extended to the radius direction outer side at the lower end of the switch sealing part 56*a*. The third sealing member 56 is formed of the material (for example, the material such as the resilient rubber etc) which has the self-elasticity. The switch sealing part 56*a* of the third sealing member 56 is inserted within the switch hole 14*sh* connected to the upper side from the inner space of the case 14, and the expansion sealing part 56*b* is fixed to the inner portion (the inner portion of the second case member 14B) with the pressing ring 14*fr* fixed to the upper side of the inner portion of the case 14 by the combining means (for example, the bolt etc). The coupling bosses arranged in the nearby of the switch hole 14*sh* may be formed at the upper side of the inner portion of the second case member 14B, and the pressing ring 11*fr* may have the combining support pieces provided with the combining means through-hole corresponding to the coupling boss. If the combining means (the bolt etc) is inserted in the combining means through-hole formed in the combining support piece of the pressing ring 14*fr* in the state that the expansion sealing part 56*b* of the third sealing member 56 is arranged between the upper surface (the top inner surface around the switch hole 14*sh*) and pressing ring 14*fr*, and the combining means is tightened in the coupling boss provided at the upper surface in the second case member 14B, the expansion sealing part 56*b* of the third sealing member 56 is fixed between the pressing ring 14*fr* and the second case member 14B. Therefore, it becomes the state where the switch hole 14*sh* of the case 14 is sealed by the third sealing member 56. And there is no case in which the external water penetrates into the switch hole 14*sh* of the case 14.

In the meantime, the secondary case cover 14D is fixed in the upper side of the second case member 14B with the combining means such as the bolt etc. The switch cap combining hole 14Dch penetrated from the outer side toward the inner side is equipped in the secondary case cover 14D. The switch cap 14*cp* is connected to the switch cap combining hole 14Dch. The switch cap 14*cp* may ascend and descend along the switch cap combining hole 14Dch. And the switch cap 14*cp* is arranged in the upper position of the third sealing member 56. The switch cap 14*cp* is provided with the expansion hanging piece extended to the radius direction outer side at the outer periphery, and the expansion hanging piece of the switch cap 14*cp* may hang on the peripheral wall around the switch cap combining hole 14Dch within the secondary case cover 14D. Therefore, while the switch cap 14*cp* does not come off from the switch cap combining hole 14Dch of the secondary case cover 14D and it can ascend and descend along the switch cap combining hole 14Dch. At the same time, the switch cap 14*cp* is arranged in the upper position of the third sealing member 56.

At this time, because the switch cap 14*cp* has the self-elasticity, the third sealing member 56 may be below pressed down. If the third sealing member 56 is pressed down, it becomes the switching-on state of the switch 11 (so to speak, the state wherein the switch 11 is turned on) equipped inside the case 14. Therefore, the drive unit 10 which is electrically connected to the battery by the medium of the switch 11 may be driven with the battery power and the driving shaft 10*a* may be rotated. If the driving shaft 10*a* is rotated, the driving gear 12 rotates and a pair of first cams 20A and the second cam 20B are rotated. In the present invention, the switch 11 may be comprised of the tact switch provided with the switching button. And if the switch cap 14*cp* and the third sealing member 56 are together pressed down and the switching button of the tact switch is pressed, the switch 11 may become said switching state so that the driving shaft 10*a* and the driving gear 12 of the drive unit 10 may be rotated. If the driving shaft 10*a* and the driving gear 12 of the drive unit 10 are rotated, the first cam 20A and the second cam 20B may be rotated. In the meantime, after the switch 11 is switched to said switching-on state, if the switch 11 is again pressed down and the pressing state of the switching button of the switch 11 is revoked by the third sealing member 56, the switch 11 may be changed to the switching-off state (so to speak, the state that the switch is turned off) and the rotation of the driving shaft 10*a* and the driving gear 12 of the drive unit 10 is stopped so that the rotation of the second cam 20B and the first cam 20A is also stopped.

Figure 14:
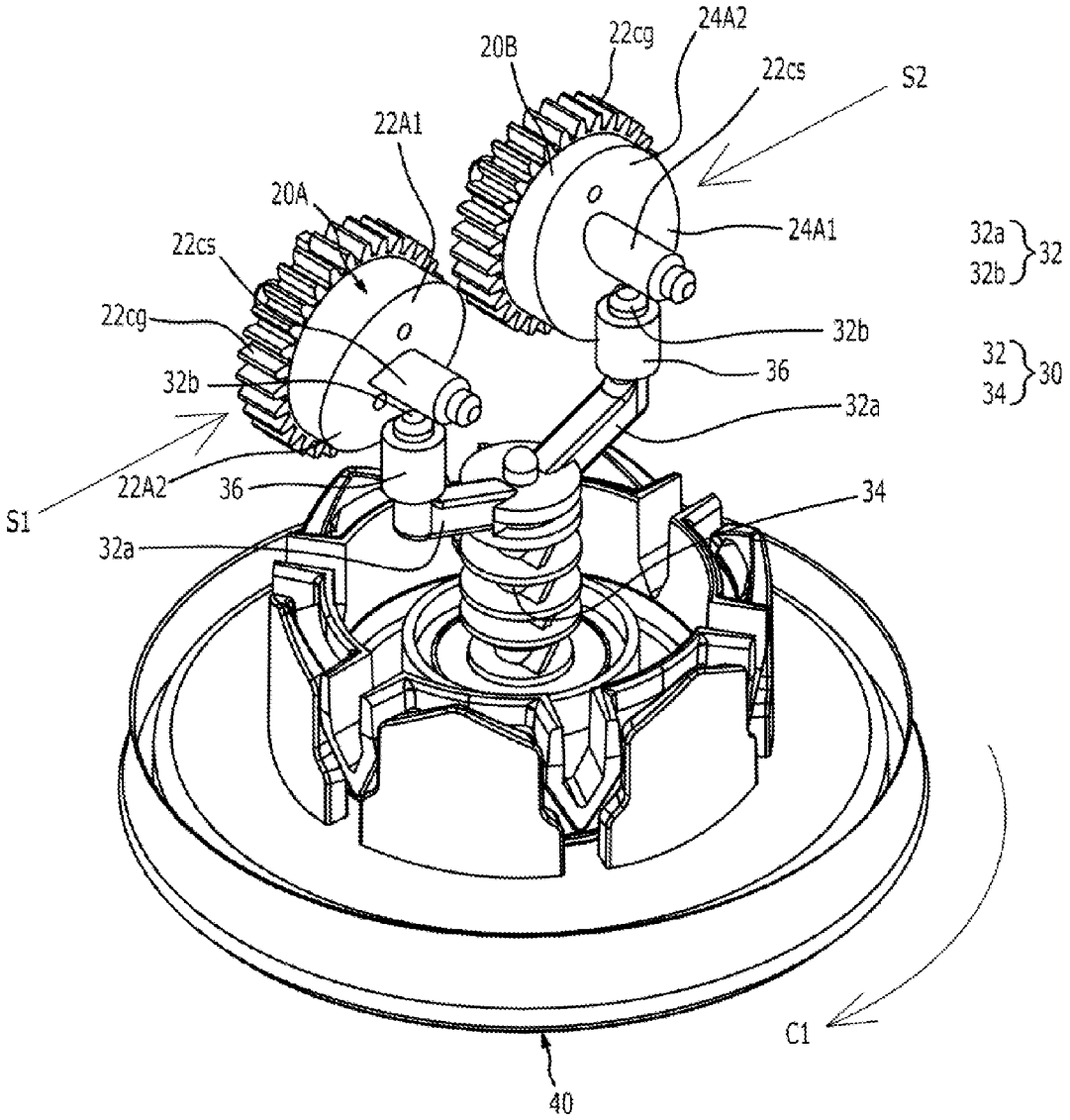
FIG. 14 is a perspective view showing the state where the rotor plate is rotated to one side direction with the rotor link which is the main part of the present invention.
Figure 15:
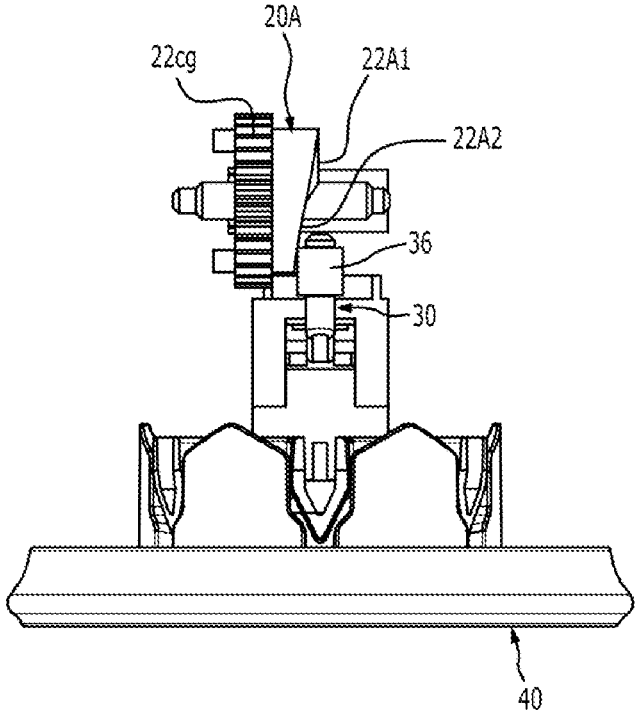
FIG. 15 is a S1 direction and S2 direction side view of FIG. 14.
Figure 15:
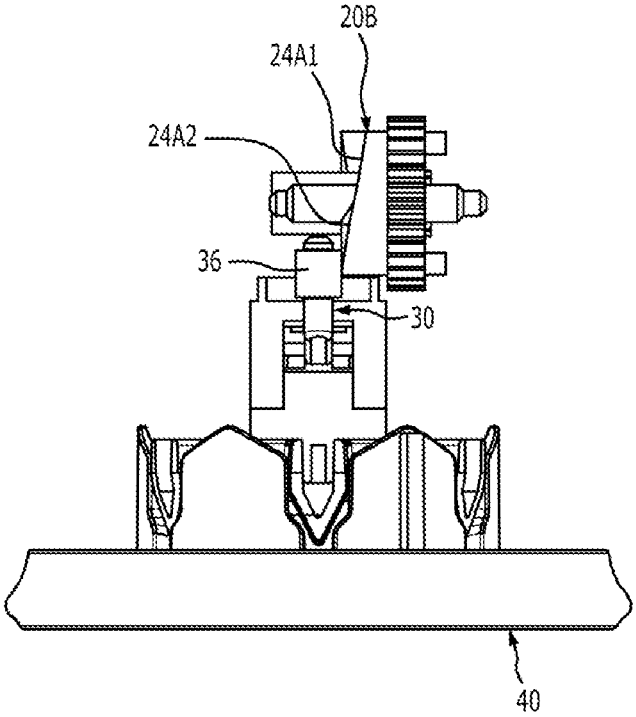
Figure 18:
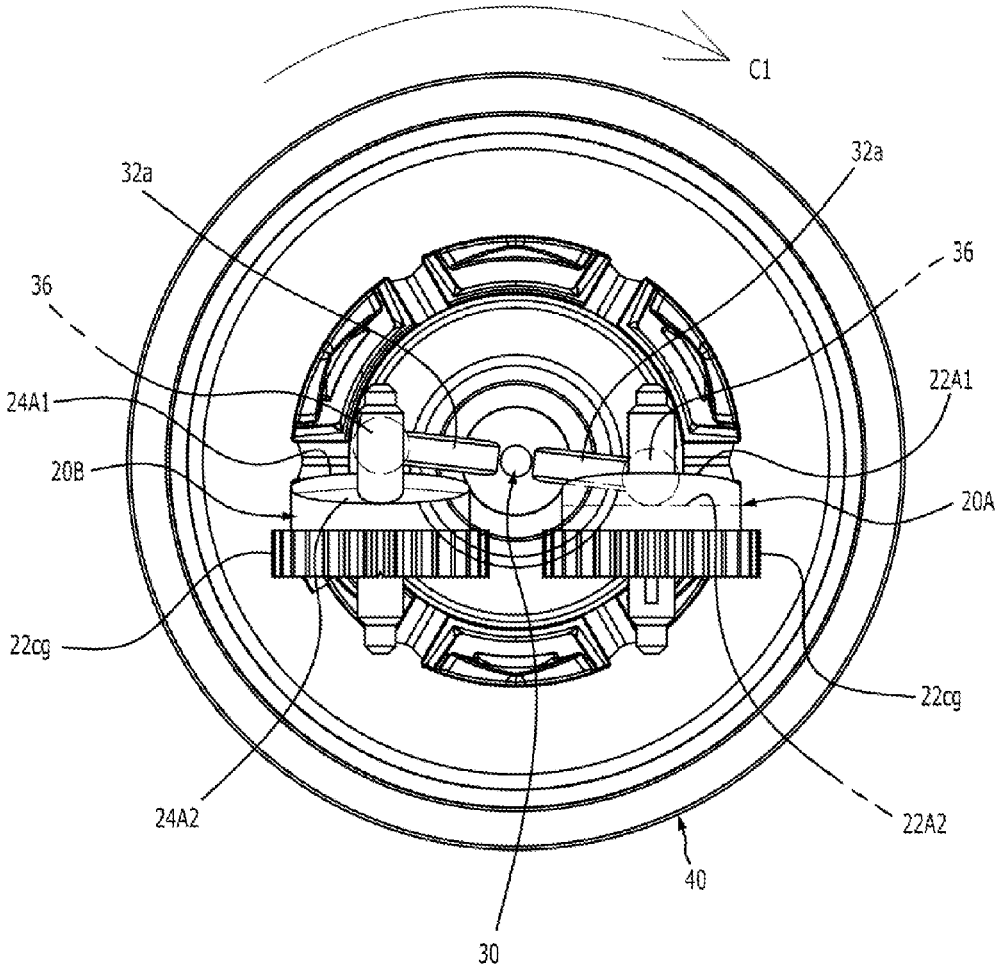

According to the invention of the above-described configuration, if the driving shaft 10*a* and the driving gear 12 of the drive unit 10 are rotated, as shown in FIG. 14, FIG. 15 and FIG. 18, the first convex cam side 22A1 of the first cam 20A rotates toward the upper position to move ahead toward the rear direction of the case 14, and the second convex cam side 24A1 of the second cam 20B rotates toward the lower position to move ahead toward the rear direction of the case 14. At this time, one side rotor arm 32 of the rotor link 30 is pushed to the front direction (so to speak, the front side of the case 14) while the state that the buffer member 36 of one side rotor arm 32 is contacted with the first convex cam side 22A1 is changed into the state that the buffer member 36 of one side rotor arm 32 is contacted with the first concave cam side 22A2 of the first cam 20A, and the other side rotor arm 32 of the rotor link 30 is pushed to the rear direction (so to speak, the rear side of the case 14) while the state that the buffer member 36 of the other side rotor arm 32 is contacted with the second concave cam side 24A2 is changed into the state that the buffer member 36 of the other side rotor arm 32 is contacted with the second convex cam side 24A1 of the second cam 20B. Two rotor arms 32 may be rotated with the rotor center shaft 34 as the rotation center to be moved forwardly and backwardly within the front and the rear section of the case 14. Like this, if the rotor 30 is rotated in order that one side rotor arm 32 of the rotor link 30 be pushed out to the front direction (the front side of the case 14) and the other side rotor arm 32 of the rotor link 30 be pushed out to the rear direction (the rear side opposite to the rear side of the case 14), the rotor plate 40 connected to the rotor link 30 rotates toward one rotation direction (C1 direction).

Figure 16:
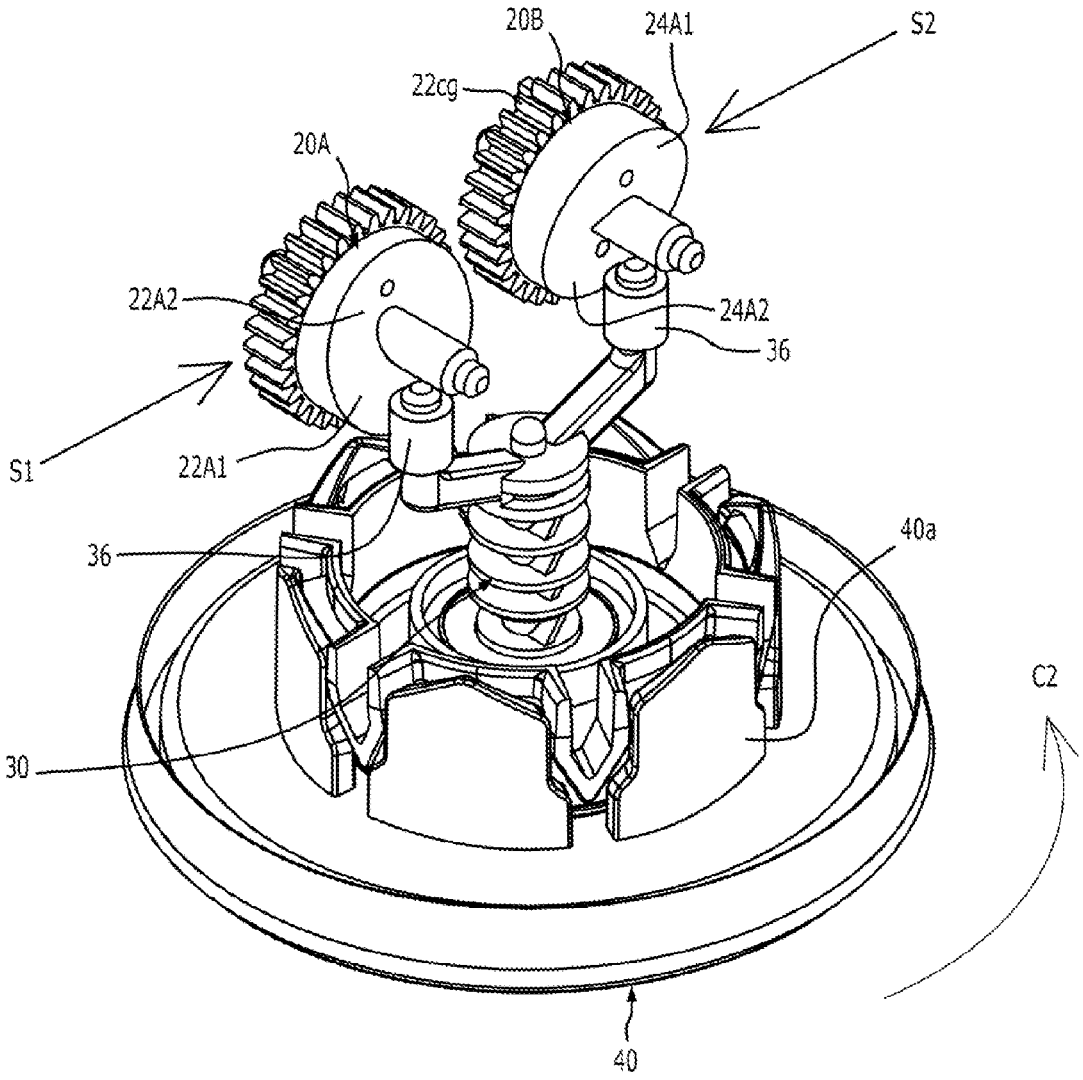
FIG. 16 is a perspective view showing the state where the rotor plate is rotated to another side direction with the rotor link which is the main part of the present invention.
Figure 17:
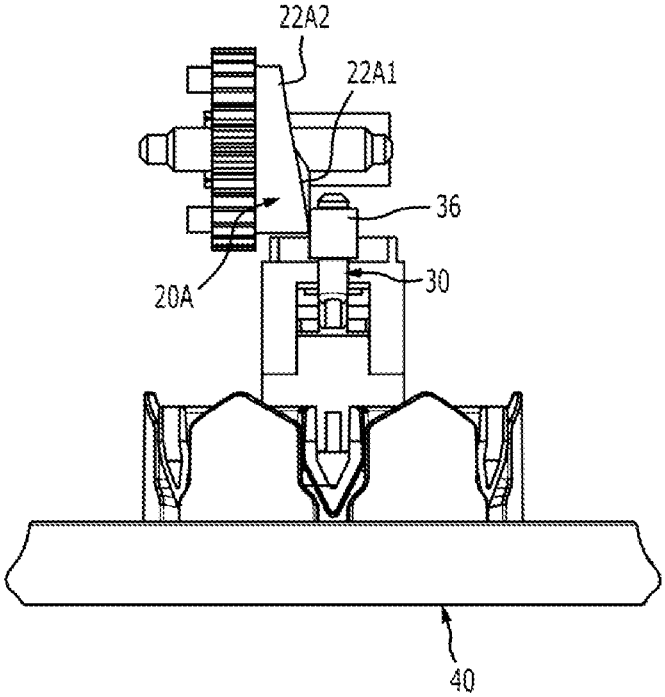
FIG. 17 is the S1 direction and S2 direction side view of FIG. 16, FIGS. 18 and 19 are the plane view showing the operation state of the main part shown in the FIGS. 14 through 17.
Figure 17:
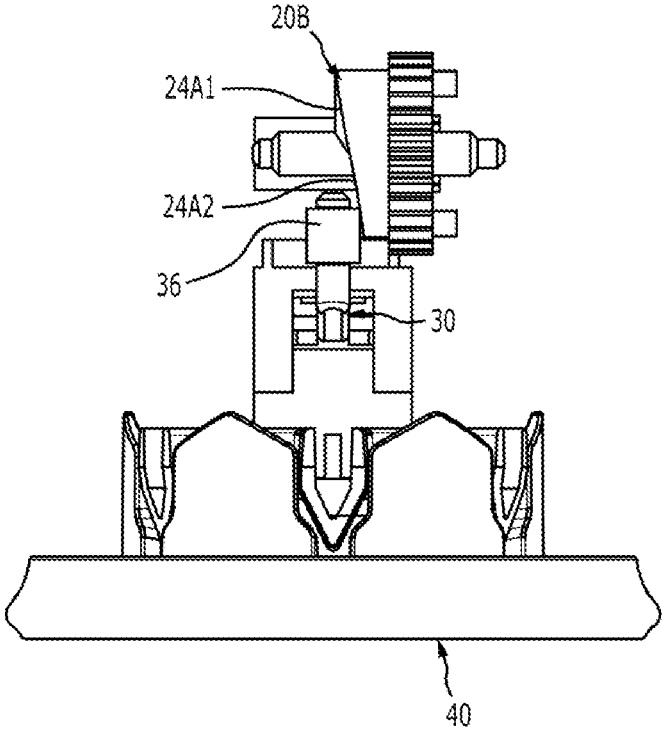
Figure 19:
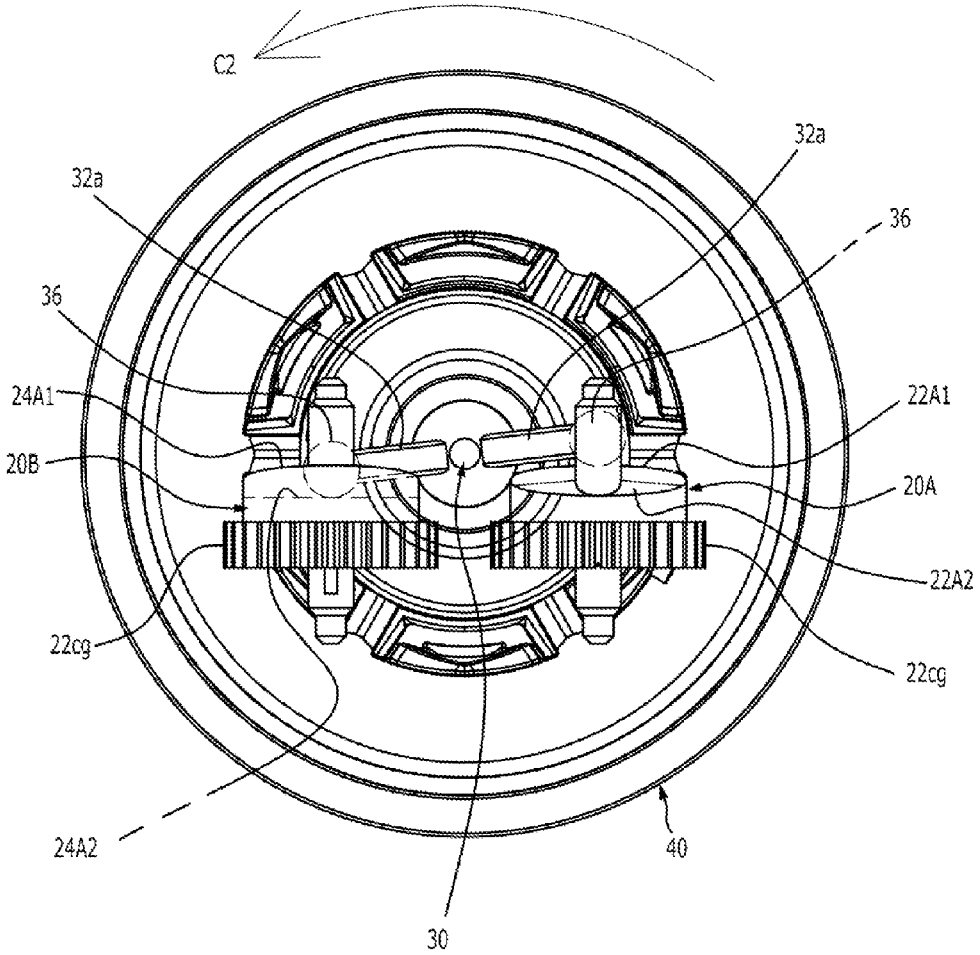

In the meantime, if the driving shaft 10*a* and the driving gear 12 of the drive unit 10 are rotated continuously, as shown in FIG. 16, FIG. 17 and FIG. 19, the first convex cam side 22A1 of the first cam 20A rotates toward the lower position to move ahead toward the rear direction of the case 14, and the second convex cam side 24A1 of the second cam 20B rotates toward the upper position to move ahead toward the rear direction of the case 14. At this time, one side rotor arm 32 of the rotor link 30 is pushed to the rear direction (so to speak, the rear side of the case 14) while the state that the buffer member 36 of one side rotor arm 32 is contacted with the first concave cam side 22A2 is changed into the state that the buffer member 36 of one side rotor arm 32 is contacted with the first convex cam side 22A1 of the first cam 20A, and the other side rotor arm 32 of the rotor link 30 is pushed to the front direction (so to speak, the front side of the case 14) while the state that the buffer member 36 of the other side rotor arm 32 is contacted with the second convex cam side 24A1 is changed into the state that the buffer member 36 of the other side rotor arm 32 is contacted with the second concave cam side 24A2 of the second cam 20B. Like this, if the rotor 30 is rotated in order that one side rotor arm 32 of the rotor link 30 be pushed out to the rear direction (the rear side of the case 14) and the other side rotor arm 32 of the rotor link 30 be pushed out to the front direction (the front side opposite to the rear side of the case 14), the rotor plate 40 connected to the rotor link 30 rotates toward the other rotation direction (C2) opposite to one rotation direction (C1 direction).

As described above, while the first cam 20A and the second cam 20B are rotating, the first convex cam side 22A1 and the first concave cam side 22A2 of the first cam 20A as well as the second concave cam side 24A2 and the second convex cam side 24A1 of the second cam 20B may by turns change the position. In accordance with the change of the position like the above, the first convex cam side 22A1 and the first concave cam side as well as the second concave cam side 24A2 and the second convex cam side 24A1 may by turns move forwardly and backwardly so that a pair of the rotor arms 32 of the rotor 30 may by turns move forwardly and backwardly. The rotor plate 40 connected to the rotor link 32 may be rotated between one direction and the other direction in accordance with the forward and backward movement of a pair of the rotor arms 32. While the first cam 20A and the second cam 20B are rotating, the constant angle round trip rotation (the C1 direction and C2 the round trip rotation) of the rotor plate 40 connected to the rotor link 30 may be performed. Therefore the function of washing the skin surface may be performed by the cleansing member (the cleansing brush etc) equipped in the rotor plate 40.

The invention comprises a pair of the rotor arms 32 which are contacted with the concave cam sides 22A2, 24A2 and the convex cam sides 22A1, 24A1 provided at the first cam 20A and the second cam 20B. According to the invention, the rotor arms 32 may be by turns moved forwardly and backwardly by the first cam 20A and the second cam 20B, and the main part may steadily maintain the balance point at both positions (that is, the left and the right position) by the rotor link 30 rotating to and fro in the case 10 and may perform the cleansing function. Accordingly, the invention has the advantage that the unnecessary noise or the vibration and so on is not generated when the main part operates for the administration of skin and the malfunction of the main part is not generated. The invention may increase the reliability of the product more.

Conventionally, because the follower which repetitively moves along the section between the top dead center and lower dead center in accordance with the rotation of the cylindrical cam is positioned at one eccentric position, there is the problem that the vibration or the noise may be very much generated and, owing to the eccentric position of the follower called the major operating unit, the malfunction is generated in the follower and the vibration axis. As a result, there is the problem that the product reliability falls down.

However, in the present invention, the first cam 20A and one rotor arm 32 of the rotor link 30 may form the driving balance point on one side spot, and the second cam 20B and another rotor arm 32 of the rotor link 30 may form the driving balance point on another side spot, the driving balance point is not made eccentric to one side but the driving balance points of two arrays balanced in both the left position and the right position may be formed. Therefore the invention may resolve the problem that the vibration or the noise of no use is much generated and the risk that malfunction is generated in the major operating unit. Due to this, consequently, the result may be expected that the product reliability is enhanced remarkably.

Moreover, in the present invention, the buffer members 36 of the soft material (for example, the silicone etc) are respectively provided at a pair of the rotor arms 32 of the rotor link 30, at the state where the buffer member 36 on one position is contacted with the first convex cam side 22A1 and the first concave cam side 22A2 of the first cam 20A and the buffer member 36 on the other position is contacted with the second convex cam side 24A1 and the second concave cam side 24A2 of the second cam 20B, the respective rotor arms 32 of the rotor link 30 may be moved forward and backward. Because the buffer members 36 may absorb the noise or the cause of generating the vibration and may perform the shock absorb function while the respective rotor arms 32 of the rotor link 30 are rotated by the first cam 20A and the second cam 20B, the risk may be is more decreased that the vibration or the noise of no use is generated during the operation of the major driving unit.

Moreover, the cam sides of the first cam 20A and the second cam 20B are comprised of the curved part with the surface curvature and the buffer member 36 equipped at the rotor arm 32 may more smoothly go over the cam side of the curved form. Therefore, the forward and backward operation of the respective rotor arms 32 of the first cam 20A and the second cam 20B and the rotor link 30 may be performed more smoothly.

Further, as described above, there is no risk that water penetrates through the combining part between the rotor link 30 rotation support part of the case 14 and the rotor link 30 because the combining part between the rotor link rotation support part of the case 14 and the rotor link 30 may be sealed by the first sealing member 52. And, there is no risk that water penetrates through the combining part between the second case member 14B and the first case member 14A because the first sealing member 52 may be pressed between the combining part of the first case member 14B and the second case member 14B and may maintain the sealing state between the combination part of the first case member 14A and the second case member 14B. And, there is no risk water penetrates through the combining part between the switch 11 and the case 14 because the third sealing member 56 may maintain the sealing state between the combination part of the case 14 and the switch 11. As a result, the damage risk may be prevented that the invention becomes out of order owing to the penetration of water from the outside to the inside. In other words, because the invention has the structure that the sealing members 52, 54 and 56 may completely seal all of the parts which have the possibility that water may penetrates, even if the user mistakenly soak the auto cleansing apparatus of the present invention in water, there is no case that water penetrates into the case 14 of the invention. Accordingly, the invention has the important meaning because the case that the main part is damaged by the water which penetrates from the outside may be prevented completely.

What is claimed is:

1. An auto cleansing apparatus comprising:

a motor disposed in a case and generating rotation power to rotate a motor shaft;

a pair of cams coupled to the motor shaft to be rotated in accordance with the rotation power of the motor, each of the pair of cams having a cam side;

a rotor link having a rotor center shaft and a pair of rotor arms arranged at both sides of the rotor center shaft to be contacted with the cam sides of the pair of cams; and a rotor plate connected to the rotor center shaft, wherein a cleansing member is detachably attached on one side of the rotor plate, wherein the cam side of each of the pair of cams has a concave portion and a convex portion, and a position of the concave portion and the convex portion is alternately changed when each of the pair of cams is rotated, wherein each of the pair of rotor arms is moved back and forth when the position of the concave portion and the convex portion is alternately changed, and wherein the rotation center shaft is reciprocally rotated when each of the pair of rotor arms is moved back and forth.

2. The auto cleansing apparatus of claim 1, wherein the pair of cams includes a first cam and a second cam, a first cam side and a second cam side respectively formed on rear sides of the first cam and the second cam, the first cam side of the first cam includes a first concave portion and a first convex portion which protrudes more than the first concave portion in a rear direction of the first cam, and the second cam side of the second cam includes a second concave portion and a second convex portion which protrudes more than the second concave portion in a rear direction of the second cam, wherein the second concave portion of the second cam side is arranged side-by-side adjacent to the first convex portion of the first cam side, and the second convex portion of the second cam side is arranged side-by-side adjacent to the first concave portion of the first cam side.

3. The auto cleansing apparatus of claim 2, wherein each of the first cam and the second cam includes a cam gear on an outer circumference surface thereof, and the motor shaft includes a driving gear on an outer circumference surface thereof, wherein the cam gear of each of the first cam and the second cam is engaged in the driving gear of the driving shaft.

4. The auto cleansing apparatus of claim 3, wherein the driving gear is positioned between the first cam and the second cam and is concurrently engaged in the cam gears of the first cam and the second cam.

5. The auto cleansing apparatus of claim 2, wherein, when one rotor arm among the pair of the rotor arms of the rotor link is arranged in a position to be contacted with the first concave portion of the first cam side, the other rotor arm is arranged on the second convex portion of the second cam side, and, when the one rotor arm is arranged in a position to be contacted with the first convex portion of the first cam side, the other rotor arm is arranged on the second concave portion of the second cam side.

6. The auto cleansing apparatus of claim 5, wherein the rotor link is rotatably disposed in the case and the center of rotation of the rotor plate is coaxially connected to the rotor link.

7. The auto cleansing apparatus of claim 5, wherein a buffer member of soft material is disposed on each of the pair of the rotor arms of the rotor link, and the buffer member of each of the pair of the rotor arms is respectively contacted with the first cam side and the second cam side.

8. The auto cleansing apparatus of claim 1, wherein the case includes a first case member for accommodating the motor, the pair of cams, and the rotor link, and a second case member combined with the first case member to cover an upper portion of the first case member, and wherein a sealing member is disposed between the second case member and the first case member.

9. The auto cleansing apparatus of claim 8, wherein a switch for turning on and off operation of the motor is disposed on the case.

* * * * *